US011613887B2

(12) United States Patent
Briggs et al.

(10) Patent No.: US 11,613,887 B2
(45) Date of Patent: Mar. 28, 2023

(54) BUILDING SYSTEM FOR MANUFACTURED HOMES

(71) Applicant: Stackhouse, Inc., Tucson, AZ (US)

(72) Inventors: Janelle Leann Briggs, Tucson, AZ (US); Ryan Timothy Egan, Tucson, AZ (US); Randel Jacob, Tucson, AZ (US)

(73) Assignee: Stackhouse, Inc., Tucson, AZ (US)

( * ) Notice: Subject to any disclaimer, the term of this patent is extended or adjusted under 35 U.S.C. 154(b) by 0 days.

(21) Appl. No.: 17/344,662

(22) Filed: Jun. 10, 2021

(65) Prior Publication Data

US 2021/0388604 A1 Dec. 16, 2021

Related U.S. Application Data

(60) Provisional application No. 63/092,334, filed on Oct. 15, 2020, provisional application No. 63/037,992, filed on Jun. 11, 2020.

(51) Int. Cl.
*E04H 1/04* (2006.01)
*E04B 1/348* (2006.01)
(Continued)

(52) U.S. Cl.
CPC ..... *E04B 1/34807* (2013.01); *E04B 1/35* (2013.01); *E04H 1/04* (2013.01); *E04B 2001/3588* (2013.01); *E04H 2001/1283* (2013.01)

(58) Field of Classification Search
CPC ... E04H 1/005; E04H 2001/1283; E04H 1/04; E04B 1/34807; E04B 1/35; E04B 1/04; E04B 2001/3588
See application file for complete search history.

(56) References Cited

U.S. PATENT DOCUMENTS 2,499,498 A * 3/1950 Hammond, Jr. ..... E04H 1/005 414/277
2,712,863 A * 7/1955 Busch ..... E04B 1/34869 4/663

(Continued)

FOREIGN PATENT DOCUMENTS

| | | |
|---|---|---|
| EP | 2792803 | 10/2014 |
| JP | H09184202 | 7/1997 |
| WO | 0183902 | 11/2001 |

OTHER PUBLICATIONS

International Search Report and Written Opinion issued in International Application No. PCT/US2021/036862 dated Nov. 5, 2021, 13 pp.

(Continued)

*Primary Examiner* — Babajide A Demuren
*Assistant Examiner* — Daniel J Kenny
(74) *Attorney, Agent, or Firm* — Davis Graham & Stubbs LLP

(57) ABSTRACT

A multi-story building (200) is described for manufactured homes (212) such as container homes. The building (200) includes a ground floor (202), a number of intermediate floors (204), and a top floor (206). The building (200) includes a throughway (208) on the ground floor (202) that allows passage of a transportation vehicle (210) such as a flatbed truck carrying a manufactured home (212). The transportation vehicle (210) can use the throughway (208) to position the manufactured home (212) in alignment with a hoistway (214). A hoist mounted on the roof (216) can then be used to hoist the home (212) to a desired floor (204 or 206).

11 Claims, 17 Drawing Sheets

(51) Int. Cl.
*E04B 1/35* (2006.01)
*E04H 1/12* (2006.01)

(56) References Cited

U.S. PATENT DOCUMENTS

| | | | | |
|---|---|---|---|---|
| 3,902,287 | A | 9/1975 | Livingston | |
| 5,903,937 | A * | 5/1999 | Clarke | E04B 1/34869 4/663 |
| 6,032,421 | A | 3/2000 | Yamada | |
| 9,617,748 | B2 * | 4/2017 | Wilson | E04B 1/34336 |
| 10,167,645 | B2 * | 1/2019 | Geiger | E04B 1/34807 |
| 10,711,476 | B2 * | 7/2020 | Ansari | E04B 1/34807 |
| 11,174,103 | B2 * | 11/2021 | Clarke | B65G 1/0464 |
| 2018/0230691 | A1 * | 8/2018 | Tsai | E04B 1/34331 |

OTHER PUBLICATIONS

"Manufactured Home Construction and Safety Standards" Title 24, Part 3280, accessed from https://www.ecfr.gov/current/title-24/subtitle-B/chapter-XX/part-3280 on Nov. 22, 2021, 127 pp.

* cited by examiner

BUILDING SYSTEM FOR MANUFACTURED HOMES

CROSS-REFERENCE TO RELATED APPLICATIONS

This application claims priority to U.S. Provisional Patent Application No. 63/037,992 entitled "MODULAR BUILDING SYSTEM FOR CONTAINER HOMES" filed Jun. 11, 2020 and U.S. Provisional Patent Application No. 63/092,334 entitled "MODULAR BUILDING SYSTEM FOR PORTABLE HOMES" filed Oct. 15, 2020. The contents of each of the above-noted provisional applications is incorporated herein as if set forth in full and priority to each of these applications is claimed to the full extent allowable under U.S. law and regulations.

FIELD OF THE INVENTION

The present invention relates generally to manufactured homes and, in particular, to a system and associated functionality for docking manufactured homes in a vertically stacked arrangement, e.g., in a multi-story building with multiple docks for manufactured homes on at least some of the floors.

BACKGROUND OF THE INVENTION

For various economic, efficiency, and ethical reasons, interest in manufactured homes has greatly expanded in recent years. Such homes include homes constructed from shipping containers, prefabricated "tiny" homes, mobile homes, and other nontraditional homes. These homes have a number of advantages including low cost, simplified lifestyle, reliable factory-built quality, and reduced environmental impact, among others. In addition, such manufactured homes need not be permanently mounted on a foundation and, therefore, present the opportunity for owners to move their homes when it is necessary to relocate for work or otherwise desirable to relocate to a new setting. It is therefore anticipated that the market for manufactured homes will continue to expand.

One particularly attractive type of manufactured home is container homes. Container homes are typically manufactured from new or recovered shipping containers. Manufacturers re-purpose these containers into attractive living spaces, compliant with local building codes, and complete with kitchens, bathrooms, bedrooms, and living/flex areas. These homes are particularly appealing to green-oriented consumers as they are often built, in large part, from recovered materials. Moreover, because of their original purpose in shipping, these homes are well-adapted structurally for repeated moves and can be efficiently transported.

One remaining challenge of manufactured homes is where to set or install them. Housing expenses include the cost of land as well as the cost of the improvement. Thus, despite the relatively low cost of manufactured homes, owners may be forced to compromise regarding the location of installation due to land costs. For example, owners may be forced to live in less dense suburban or exurban areas due to land costs, thereby entailing a less desirable standard of living for some. In this regard, apartments or condominiums retain some advantages related to reduced/shared footprint, economies of scale, and availability of common areas and other facilities to increase the effective living space of inhabitants.

SUMMARY OF THE INVENTION

The present invention is directed to a system and associated functionality for installing manufactured homes in a vertically stacked arrangement. In certain embodiments, manufactured homes can be readily installed in standardized docks of a multi-story building and removed therefrom when desired. In this manner, multiple manufactured homes can be installed in a building with a reduced footprint, thereby providing an opportunity to realize the advantages of a manufactured home in an area with a high cost of land, e.g., dense areas such as downtown or close-in sections of cities. In addition, various amenities, such as utilities and network connections, are readily available for reduced costs and efficient move-ins. Shared resources such as common areas, balconies, recreation areas, and flex space can also be provided. The advantages of manufactured homes can thus be married to many advantages of apartment or condominium living to establish a new standard for green, efficient, versatile, and sustainable home ownership.

In accordance with one aspect of the invention, a docking system and associated functionality is provided for installing manufactured homes. Each manufactured home has an internal living space built on a structural frame (e.g., chassis) having a frame bottom. The structural frame allows the manufactured home to be lifted and moved. The manufactured home also has at least one doorway, where a bottom of the doorway is vertically offset from the frame bottom, e.g., the doorway bottom may be several inches above the frame bottom. The system includes a platform (e.g., a floor) having an upper surface for providing access to the manufactured home and a dock, disposed in the platform, for receiving a first manufactured home. The dock includes dock structure defining a recess relative to the platform configured such that, when the first manufactured home including the frame bottom is disposed in the recess, the doorway bottom is no lower than the upper surface of the platform. For example, the doorway bottom may be aligned with the upper surface of the platform such that there is a minimal bump or threshold associated with passing from the platform through the doorway into the internal living space of the manufactured home. The doorway bottom may, for example, be vertically above the upper surface of the platform by a distance of no more than about ½ inch. In this manner, the floor of the manufactured home and the platform may be perceived as defining a substantially continuous floor or plane and movement into and out of the manufactured home is simplified particularly for individuals in wheelchairs.

As noted above, the frame bottom of the manufactured home may be vertically offset from the door bottom of the doorway. The recess may thus be configured such that the platform is aligned with the bottom of the doorway. In this regard, the recess may have a depth of between about 3-6 inches, for example, about 4 inches. Moreover, the width and length of the recess may substantially match the footprint of the manufactured home. In the case of a manufactured home the recess may have a rectangular configuration with a width of about 8-10 feet and a length of about 40-50 feet. The width and length may be slightly greater than the dimensions of the manufactured home to leave room for the manufactured home to be inserted into the recess and removed from the recess. A securing mechanism may be provided to secure the manufactured home in the recess.

The dock structure defining the recess may include a support assembly for supporting the frame bottom. For example, the support assembly may include a ledge that extends about at least a portion of the periphery of the recess and extends inwardly into the recess to support the frame bottom. In addition, the support assembly may include at least one opening for providing access to an underside of the manufactured home, for example, for access to utility connections. Such a support assembly may include a central support structure extending across the recess under the manufactured home. The central support structure preferably includes a plurality of support elements extending across the recess and may include elements extending across the width and length of the recess. For example, the central support structure may include a structural grating extending across the recess between opposite portions of the ledge. The structural grating may be formed from metal, e.g., aluminum or steel, and may include a web of metal elements that define cells of rectangular, hexagonal, or other shape. The grating provides a structure of sufficient strength to assist in supporting the bottom of the manufactured home while reducing weight in relation to solid panels. One or more access openings may be provided in the dock structure to allow access to a bottom of the manufactured home for utility access. The opening may be formed in the grating and may be open or covered with a hatch door, e.g., a sliding or hinged door.

An associated method of use involves providing a residential structure as generally described above including a platform and a dock, transporting the manufactured home to the residential structure on a transportation vehicle such as a flatbed truck, removing the manufactured home from the transportation vehicle, and positioning the manufactured home in the recess of the dock structure. For example, the manufactured home may be removed from the transportation vehicle by a crane or a hoist such as a hoist mounted on the building structure as described below. The manufactured home may be raised to a desired level via a hoistway of a building and then transported to the dock structure, for example, on a wheeled structure, by a mobile jack structure, by a gantry mounted overhead transport system, or other overhead or bottom lateral transportation system.

In accordance with another aspect of the present invention, a multi-story building for manufactured homes is provided. The building generally includes a building structure and a lifting device mounted on the building structure. The building structure has a number of vertically stacked floors where each floor includes a number of manufactured home docks. The lifting device is operative to lift a manufactured home to a desired one of the vertically stacked floors. In one embodiment, the lifting device mounted at a top of the building structure (e.g., on the roof). The lifting device may be positioned at any convenient location including at a central location of the building structure or at a periphery thereof. In one embodiment, a hoist is mounted above a hoistway extending through multiple floors of the building at a central location. The docks on adjacent floors of the building may be at least partially offset relative to one another, e.g., by configuring the docks at different orientations, to facilitate access to a bottom surface of the manufactured homes for utility connections or the like.

An associated method involves providing a building structure including a plurality of vertically stacked floors were each floor includes a plurality of manufactured home docks, and operating a lifting device, mounted on the building structure, for lifting a manufactured home to a desired one of the vertically stacked floors. For example, a manufactured home may be lifted to a desired floor by a hoist and the manufactured home may then be moved to a desired dock structure using a lateral transportation system.

In accordance with a still further aspect of the present invention, a building for manufactured homes with a hoistway with deployable flaps is provided. The building includes a hoistway opening disposed in a floor where the hoistway opening is dimensioned such that a manufactured home can fit through the hoistway opening. The hoistway may extend through multiple floors. A number of guide flaps are pivotably connected to the edges of the hoistway opening where the guide flaps can pivot from a first orientation angled relative to the floor in a second orientation parallel to the floor. In this manner, the guide flaps may be positioned in the first orientation to allow and guide passage of a manufactured home through the hoistway opening and then positioned in the second orientation to define a safety catwalk for staging the manufactured home, placing wheels on the manufactured home, rigging removal, and other hoisting and docking tasks. In this manner, the guide flaps may be positioned in the first orientation to allow and guide passage of a manufactured home through the hoistway opening and then positioned in the second orientation to define a safety catwalk for staging the manufactured home, placing wheels on the manufactured home, rigging removal, and other hoisting and docking tasks.

BRIEF DESCRIPTION OF THE DRAWINGS

For a more complete understanding of the present invention and further advantages thereof, reference is now made to the following detailed description, taken in conjunction with the drawings, in which.

DETAILED DESCRIPTION

The present invention relates to building structures, and associated functionality, for creating a residential environment for manufactured homes. In the following description, the invention is set forth in the context of specific designs for multi-story buildings with multiple docks on individual floors for installing manufactured homes constructed from shipping containers. These designs are believed to represent a particularly advantageous implementation of the present invention. However, it will be appreciated that various aspects of the present invention are not limited to a particular type of manufactured home (e.g., container homes) or building structures. Accordingly, the following description should be understood as illustrative and not by way of limitation.

In the following description, examples of container homes are first described. Thereafter, a number of multi-story building designs for manufactured homes are described. A specific multi-story building design for manufactured homes is then described in greater detail. Finally, various infrastructure systems for a multi-story building for manufactured homes are described.

Figure 14:
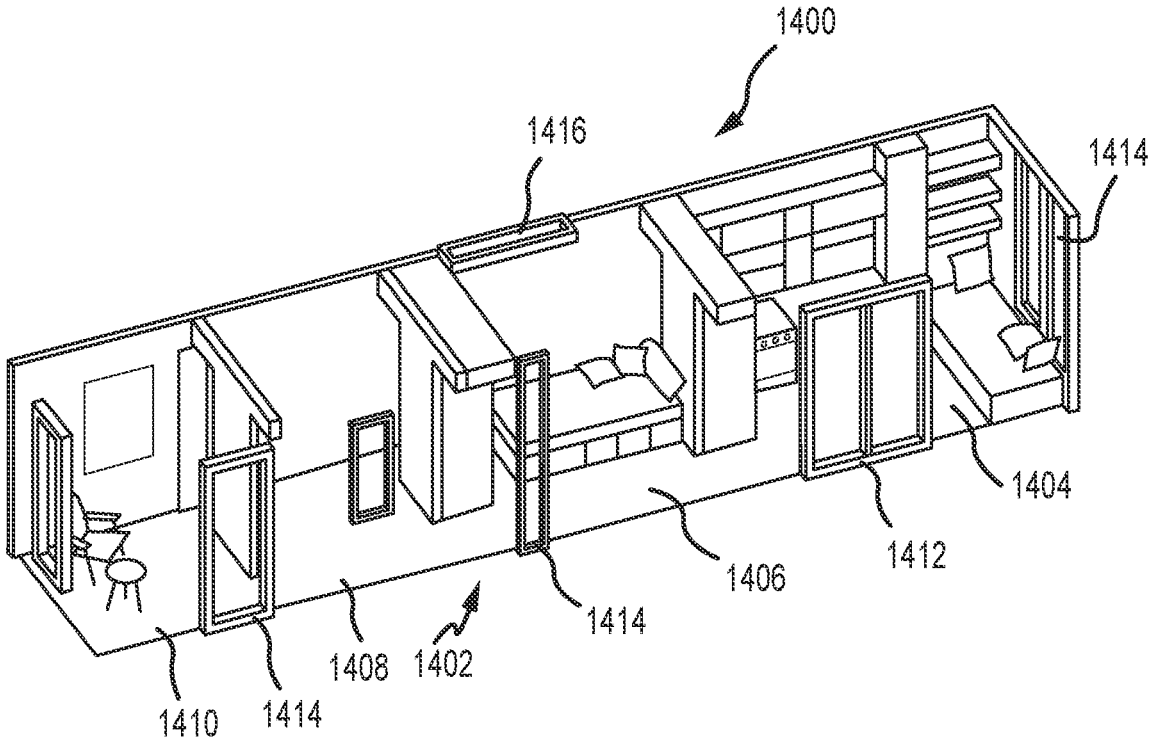
FIG. 14 shows a perspective view, partially cut-away, of a manufactured home in accordance with the present invention.

FIGS. 14-17 show container home designs that illustrate the flexibility of floor plans that may be realized in a building for container homes. Referring to FIG. 14, a perspective view, partially cut-away, of a container home 1400 is shown. The container home 1400 includes an internal living space 1402 divided into a number of rooms. In the illustrated example, the rooms include a kitchen/flex space 1404, a bedroom 1406, a bathroom 1408 and a living room 1410. Access to the internal living space 1402 is provided by a doorway 1412, in this case, a sliding door. A number of windows 1414 and a skylight 1416 may be provided for lighting. As will be described in more detail below, the home 1400 may be equipped with utilities such as water, electricity, Internet/data network connections, and gas (e.g., propane or natural gas) as desired.

Figure 15:
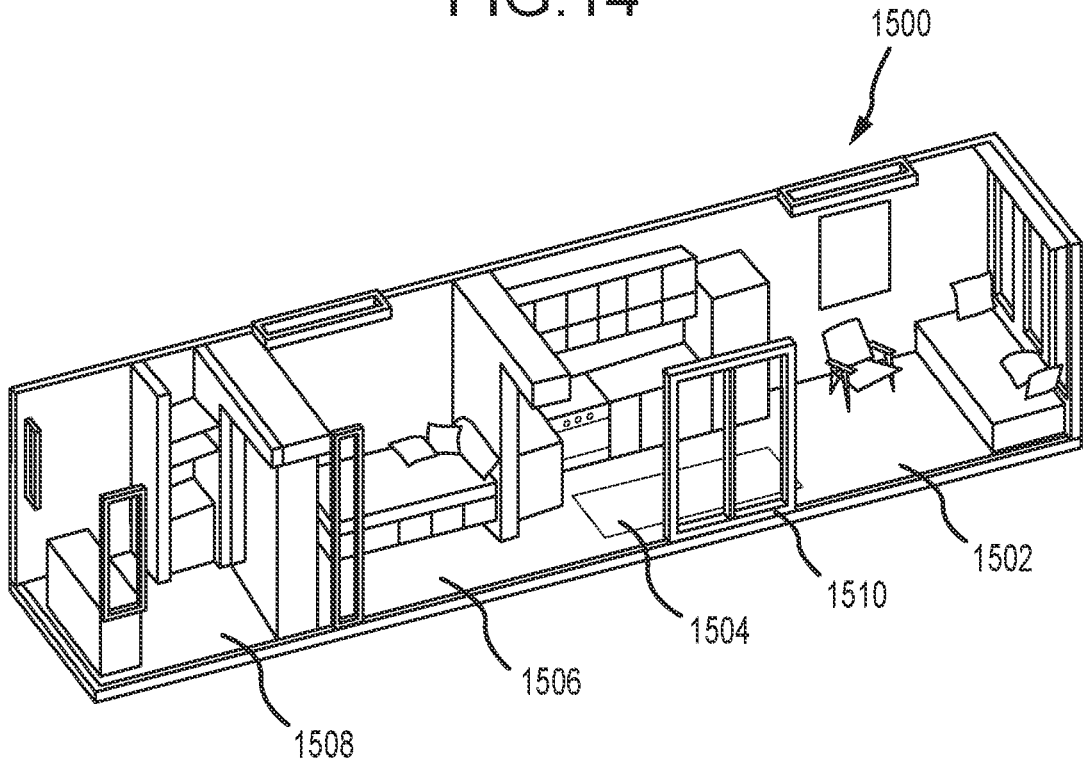
FIG. 15 shows a perspective view, partially cut-away, of a further manufactured home in accordance with the present invention.

FIG. 15 shows an alternative configuration of a container home 1500. In this case, the home 1500 includes a kitchen/flex space 1502, a bedroom 1506 and a bathroom 1508. Again, the home 1500 includes a sliding door 1510 to allow access into the internal living space.

Figure 16:
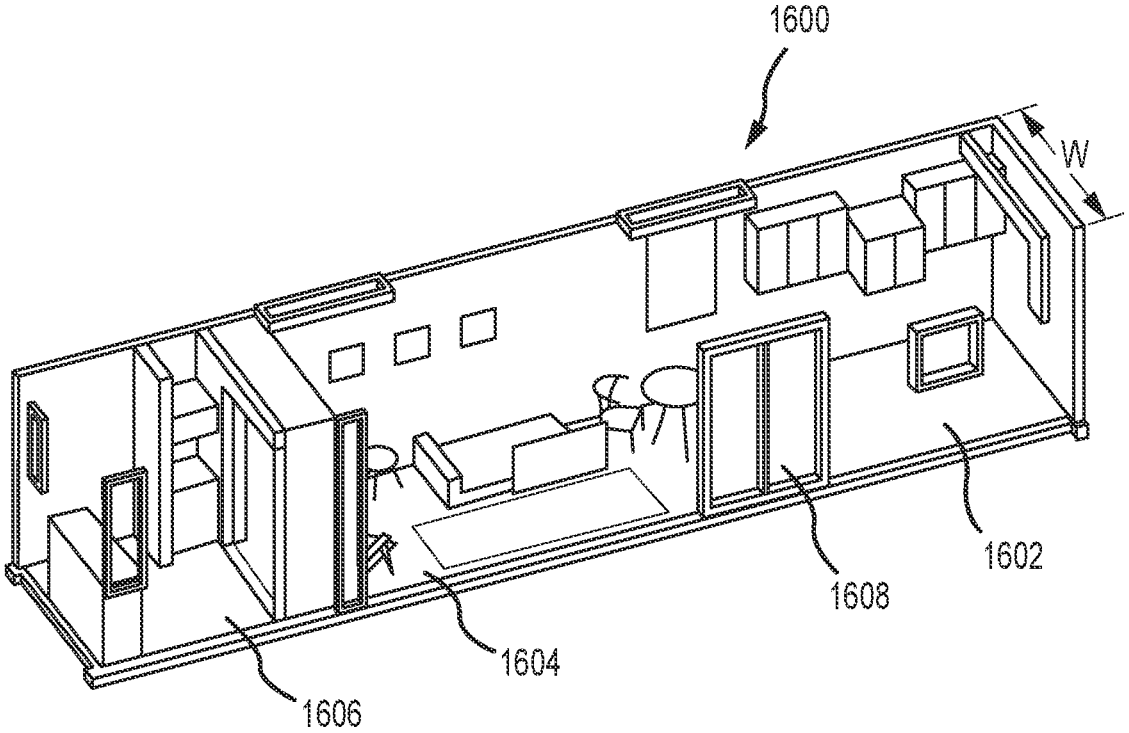
FIG. 16 shows a perspective view, partially cut-away, of a still further manufactured home in accordance with the present invention.

FIG. 16 shows a still further configuration of a container home 1600. In this case, the home 1600 includes a kitchen/office 1602, a living room/flex space 1604 and a bathroom 1606. The illustrated rooms 1602 and 1604 are connected in an open floor plan. It will thus be appreciated that, despite the space limitations of a standard container home, a variety of floor plans and lifestyles can be supported.

Figure 17:
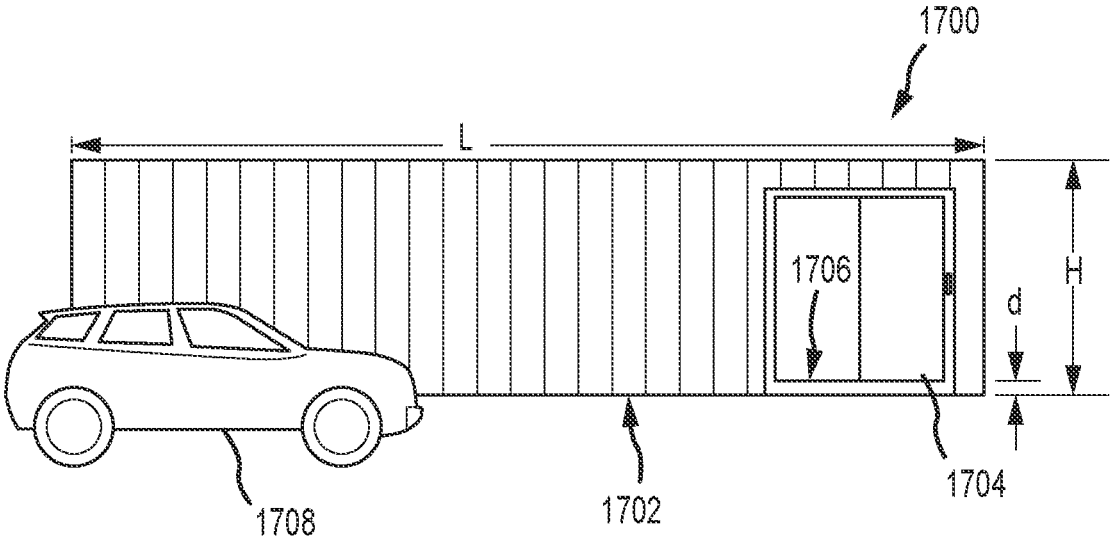
FIG. 17 shows a side elevational view of a manufactured home in accordance with the present invention.

FIG. 17 shows a front elevational view of a container home 1700 showing the dimensions of a typical container home formed from a standard shipping container. A standard container home may have a length, L, of about 20 or 40 feet, a width, W (FIG. 16), of about 8 feet, and a height, H, of about 8'6". So-called high cube containers may have an additional foot of height for a total height of 9'6". It will be appreciated, however, that the invention is not limited to specific manufactured home dimensions.

As will be understood by those skilled in the art, container homes may be formed from new or recovered shipping containers. Such shipping containers generally include a peripheral frame, for example, formed from steel structural members, and panels for enclosing the top, bottom, and sides of the container. Thus, an uninterrupted internal volume is defined. This volume allows for great flexibility in accommodating a variety of floor plans for container homes. The shipping containers are designed to be lifted, moved, and stacked, for example, on decks of train cars or shipping vessels. Accordingly, the shipping containers have substantial structural strength to support such movement and stacking. Moreover, the dimensions of the shipping container and certain exterior features are designed to be standardized for easy handling and stacking. Accordingly, container homes can be readily transported on flatbed trucks, trains, ships and other transportation vehicles. Moreover, because shipping containers are manufactured in substantial volumes, new and recovered shipping containers are readily available for cost-effective container home construction.

As shown in FIG. 17, the illustrated home 1700 includes a door 1704. The door includes a door bottom 1706 that is substantially flush with the floor of the internal living space of the home 1700. The door bottom 1706 is vertically offset from a bottom 1702 of a frame of the home 1700 by a distance, d. As will be understood from the description below, the home 1700 may be recessed into a dock structure of a building. Such a recessed dock structure assists in securing the home 1700 in place in the building. The home 1700 is recessed into the docking structure to a depth that is no more than the distance d. For example, the home 1700 may be recessed into a platform of the building 3 to 6 inches, for example, about 4 inches. In this regard, the home 1700 may be recessed into the platform by a distance that is substantially equal to or slightly less than the distance d. In one implementation, the difference between the distance that the home 1700 is recessed into the platform and the distance d is no more than about ½ inch.

In this manner, the floor of the internal living space of the home 1700 and the platform of the building may be perceived as forming a substantially continuous floor. In addition, movement between the platform and the internal living space is facilitated without potential tripping obstacles and passage through the door 1704 is facilitated, including for individuals in wheelchairs.

Figure 18:
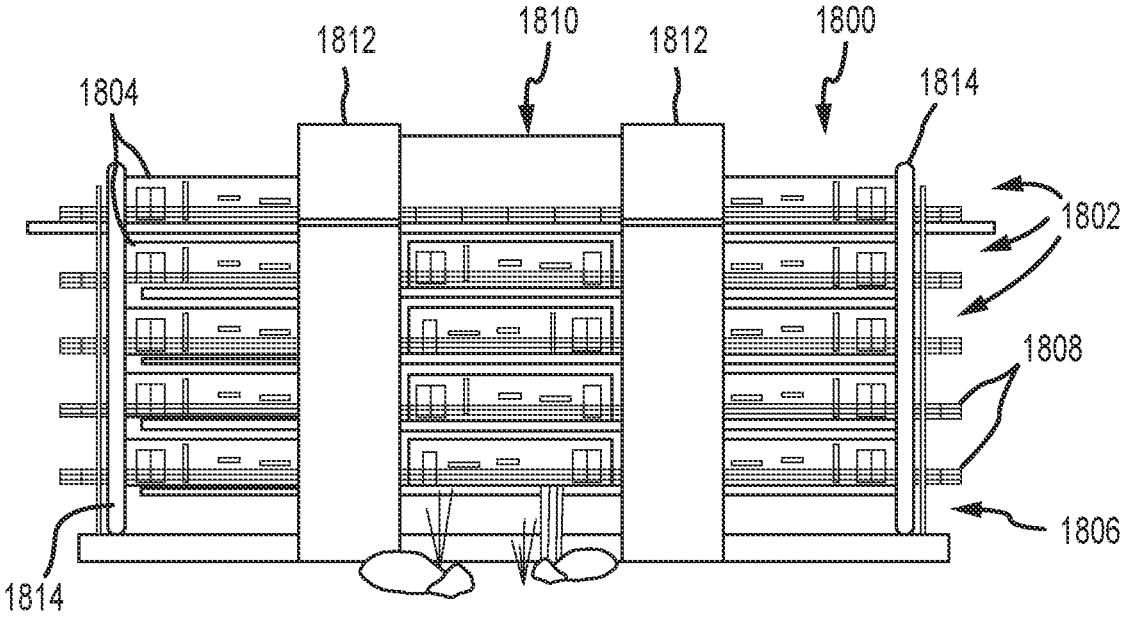
FIG. 18 shows a side elevational view of a multi-story building for manufactured homes in accordance with the present invention.
Figure 19:
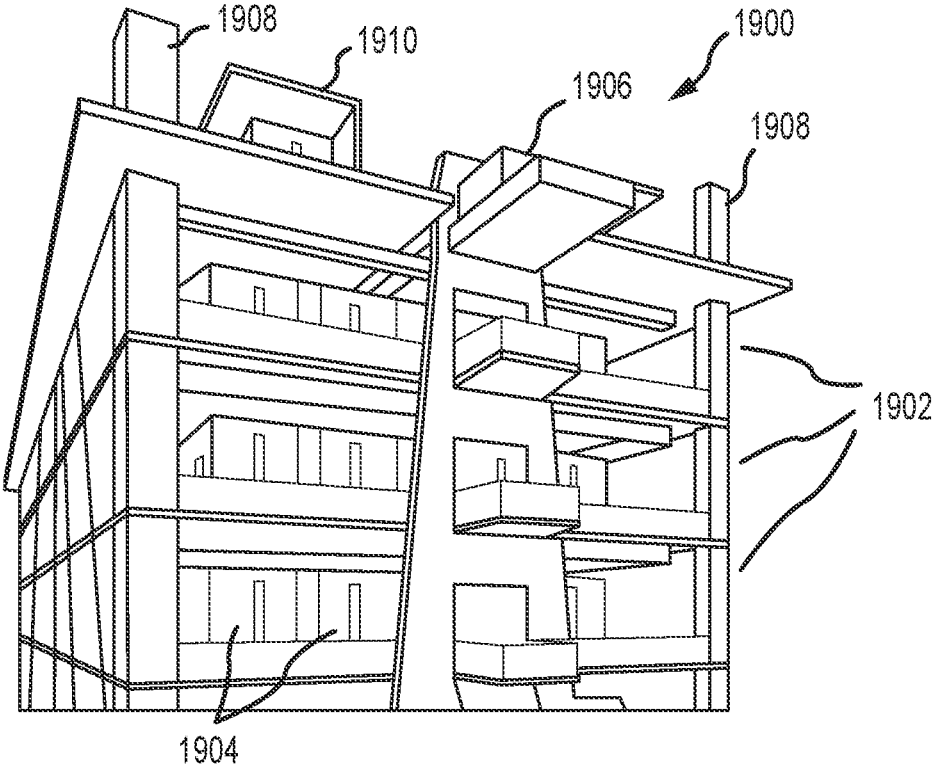
FIG. 19 shows a perspective view of another multi-story building for manufactured homes in accordance with the present invention.
Figure 20:
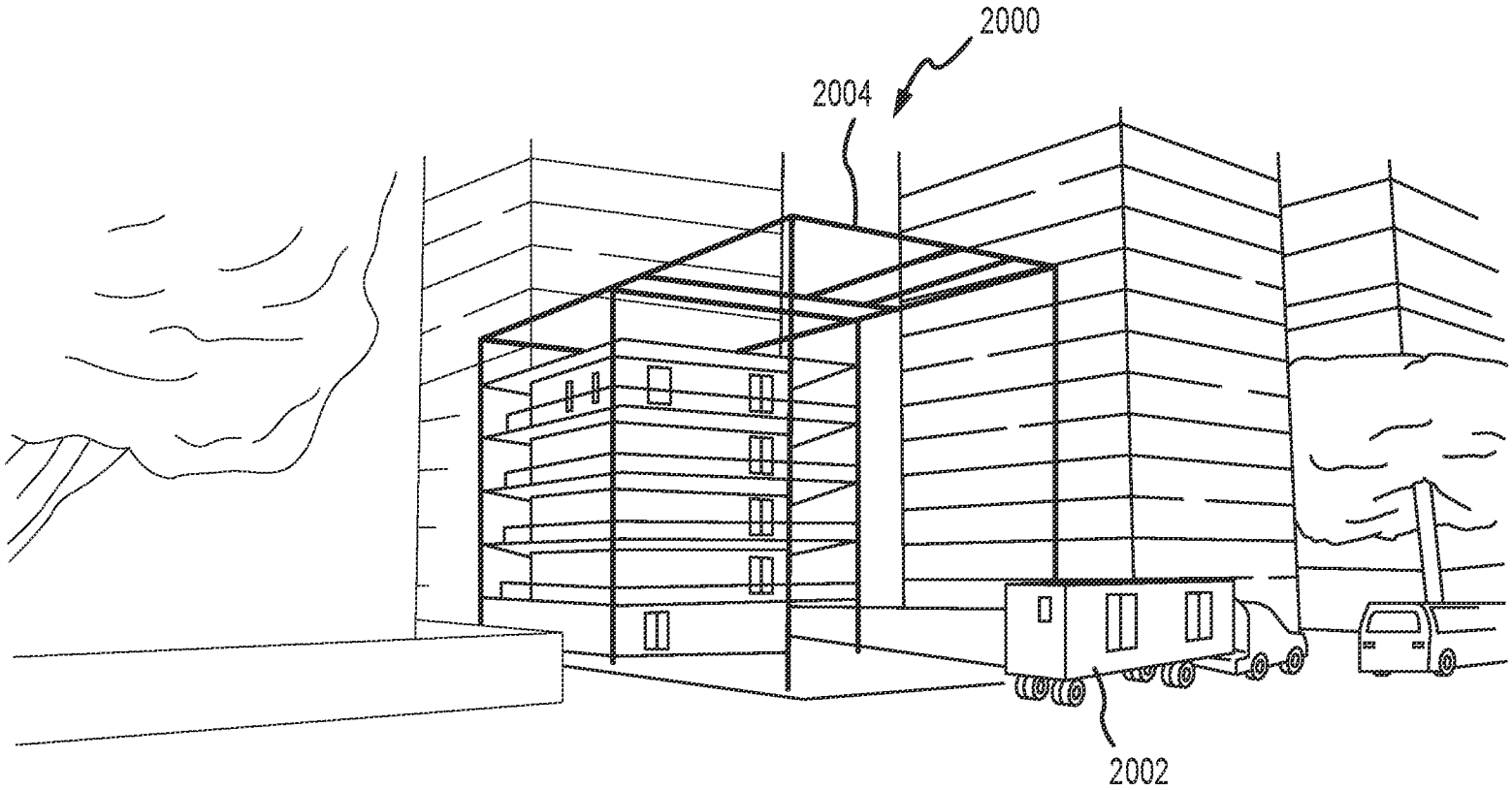
FIG. 20 shows a perspective view of a still further multi-story building for manufactured homes in a metropolitan environment in accordance with the present invention.

FIGS. 18-20 show examples of multi-story buildings for manufactured homes in accordance with the present invention. Referring to FIG. 18, a side elevational view of a multi-story building 1800 is shown. The illustrated building 1800 includes multiple stories or floors 1802. Each of the floors 1802 (except the ground floor 1806) includes docks, as will be described in more detail below, for multiple manufactured homes 1804. The ground floor 1806 includes parking spaces as well as access for a transportation vehicle, such as a flatbed truck, to be driven through the building 1800 into alignment with a lifting device, as will be described in more detail below, to lift a manufactured home from the transportation vehicle to a desired one of the floors 1802.

FIG. 18 shows additional features of the building 1800. The illustration building 1800 may include a number of common spaces for use by the owners of the manufactured homes 1804. For example, these common spaces may include balconies 1808 as well as common walkways, gardens, culinary cubes, community flex space, exercise areas, picnic areas or tables, and the like. The building 1800 also includes a roof 1810 that may include common areas and/or a variety of infrastructure systems for the building 1800. For example, a lifting device such as a hoist may be mounted on the roof 1810, e.g., at a central location, for use in lifting a manufactured home from a transportation vehicle on the ground floor 1806 to a desired floor 1802 via a hoistway, as will be described in more detail below. In addition, rain collection tanks may be disposed on the roof 1810 (and/or other floors) to collect rainwater for use in common areas and/or by residents of the building 1800. The building 1800 may further include stairways and/or elevators disposed in structural columns 1812 to allow movement between the various floors 1802 and 1806 as well as optionally allowing access to the roof 1810. Finally, the building 1800 includes ventilation towers 1814 for capturing wind to improve ventilation to the various floors 1802 and 1806.

As will be discussed in more detail below, the spacing between the various floors 1806 and 1802 is greater than the height of the manufactured homes 1804. For example, the height of the manufactured homes may be between about 8-10 feet, for example 8'6". Moreover, each of the homes 1804 may be recessed into the floor structure or platform defining the various floors 1802. Accordingly, the effective height of the manufactured homes 1804 may be close to or slightly more than 8 feet. In the illustrated building 1800, the ground floor has a height of about 14'6" and the other floors 1802 (other than the top floor) have a height of about 12'6". Substantial clearance is thus provided between the top of each manufactured home 1804 and the structure of the floor immediately above. Such clearance serves a number of purposes. First, such clearance improves airflow and ventilation through the building 1800. In addition, this clearance provides space for facilitating transportation of the homes 1804 from a central hoistway to a desired dock and vice a versa. It will be appreciated that such transportation may involve the use of wheels, such as a mobile jack, or an overhead trackway. Finally, this clearance facilitates access to the underside of the mobile homes 1804, for example, for connecting utilities such as water, electricity, gas, and Internet or data connections. The increased height of the ground floor 1806 enables access by a flatbed truck or other transportation vehicle to load or unload a home 1804.

FIG. 19 shows a perspective view of a further multistory building 1900 for manufactured homes 1904. As shown, the homes 1904 are disposed on multiple floors 1902 of the building 1900. The building 1900 further includes a number of common areas such as balconies 1906. Towers 1908 at the corners of the building 1900 provide structural support for the floors 1902 as well as capturing wind for improved ventilation on the floors 1902. In the illustrated building 1900, one or more docks for homes 1904 are provided on the roof 1910. These may be used for penthouse locations or common areas such as flex space or exercise space. These top floor spaces may be shielded by a cover 1910 for shading and protection against the elements.

FIG. 20 shows a still further example of a multistory building 2000 for manufactured homes. Although the discussion below includes a detailed description of multi-story buildings with an internal hoistway for manufactured homes, it will be appreciated that such an internal hoistway may not be desired or necessary in certain implementations. FIG. 20 shows a building 2000 in a metropolitan environment, in this case, surrounded by tall buildings. In such cases, the spatial footprint of the building 2000 may be limited. The illustrated building 2000 provides a solution for such environments. The building 2000 includes a building structure 2004 including multiple floors for the manufactured homes. The building structure 2004 also extends outwardly from the location of the manufactured homes towards a street. A mobile hoistway or crane mounted on the structure 2004 can move forwardly to unload a home 2002 from a transportation vehicle such as a flatbed truck. The mobile hoistway or crane can then transport the home 2002 rearwardly from the street to a docking location in the structure 2004. The mobile hoistway or crane may also move from side-to-side, or include a pivotable arm for lateral movement, to position homes in the building. The forward portion of the structure 2004 closest to the street may be used as a common yard for the residents of the building 2000. In addition, although not shown, the forward portion may be enclosed or partially enclosed to define an atrium that provides some protection against the elements. It will be appreciated that the building 2000 allows multiple homes to be located within the building 2000 in a stacked configuration. In this manner, residents can cost-effectively locate their homes in an area with a higher cost of land, such as in a downtown or close-in area of a city.

Referring to FIGS. 1-13C, specific embodiments of a building for manufactured homes will now be described in more detail. These embodiments feature a multi-story building structure that can support multiple housing units. In these embodiments, the building structure comprises a plurality of stacked floors.

In the description below, the terms "HUD home," "HUD housing unit," and "HUD manufactured home" are used interchangeably. A HUD home refers to a manufactured home constructed according to the Manufactured Home Construction and Safety Standards (HUD Code) administered by the U.S. Department of Housing and Urban Development. The HUD Code, unlike conventional building codes, requires manufactured homes to be constructed on a permanent chassis. A HUD manufactured home displays a red certification label on the exterior of each transportable section. They are built in a controlled environment of a manufacturing plant and are transported in one or more sections on a permanent chassis or frame. Other names for manufactured homes include mobile homes, sectional homes, double wide homes, trailers, and HUD code homes.

The Manufactured Home Construction and Safety Standards are available at https://www.ecfr.gov/cgi-bin/text-idx?tpl=/ecfrbrowse/Title24/24cfr3280_main_02tpl. As an example, the HUD code includes the following room requirements: a) every manufactured home shall have at least one living area with not less than 150 ft.$^2$ of gross floor area; b) rooms designed for sleeping purposes shall have a minimum gross square foot floor area as follows: (1) all bedrooms shall have at least 50 ft.$^2$ of floor area; (2) bedrooms designed for two or more people shall have 70 ft.$^2$ of floor area plus 50 ft.$^2$ for each person in excess of two; and (c) every room designed for sleeping purposes shall have accessible clothes hanging space with a minimum inside depth of 22 inches and shall be equipped with a rod and shelf.

As used herein, "modular homes," are built to the same local, county, and state building codes, or other applicable codes outside United States, as site-built homes such as, for example, the International Residential Construction (IRC) code. Other names for modular homes include factory-built homes, pre-built homes, pre-engineered homes, pre-fab homes, and MODs. All of these homes, including modular homes and HUD homes, are examples of manufactured homes. The terms "container home," "container," and "shipping container" are used interchangeably herein to refer to manufactured homes constructed from new or recovered shipping containers. Such homes may be modular homes or HUD homes and are a particularly advantageous example of a manufactured home that may be used in the multi-story buildings as described below.

As used herein, the term "intermediate floor" refers to any floor between the ground floor and the topmost floor. For example, in a 5-story building, the second, third, and fourth floors are intermediate floors. The ground floor refers to the first floor at street level or sub-street level.

As used below, the term "housing unit" may refer to a HUD home, a modular home, a tiny home or cabin, a portable building, or homes constructed from re-purposed containers, sheds, and campers. In some embodiments, the housing units are prefabricated homes, cabins, sheds, or containers. In preferred embodiments, the housing units are portable structures. For example, the housing unit may be a single portable unit or may comprise multiple portable sections, e.g., housing sections that are joined together to form a unitary structure. In one embodiment, a HUD certified home is comprised of two sections that are combined lengthwise to form a double wide manufactured home. A single wide home, or single section home, is a floor plan with one long section rather than multiple sections joined together.

Figure 1:
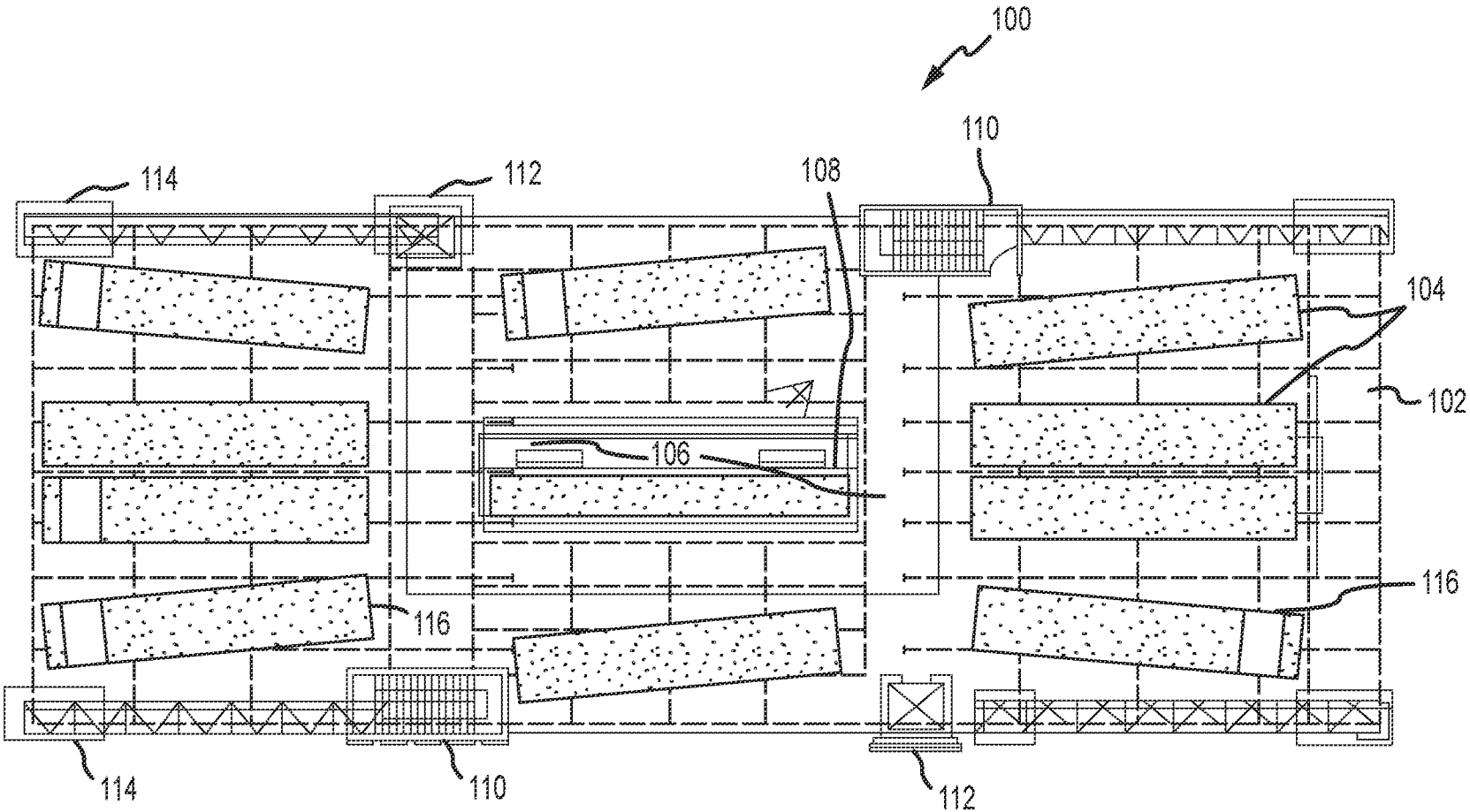
FIG. 1 is a top view of a floor of a building for manufactured homes according to an embodiment of the present invention.

FIG. 1 shows a floor plan 100 for a single floor 102 of a multi-story building. As shown, the floor plan 100 includes a number of docks 104 distributed about a central hoistway 106. The hoistway 106 includes a retractable safety catwalk 108 that pivots between an open position to allow passage of a home through the hoistway 106 and a closed position, where the catwalk panels are parallel to and aligned with the floor. In the closed position, the catwalk 108 allows for staging of container homes, wheel placements for transporting the homes to the docks 104, removal of the rigging for the hoist, and other hoisting and docking tasks.

The illustrative floor plan 100 further includes access for stairways 110 and elevators 112 as well as towers 114 with internal ventilation ducts. One or more of the docks 104 may include an access opening 116 to allow access to utility connections on the underside of a manufactured home from below. The opening may have a covering or panel that can be opened and closed as desired. The location of the access openings 116 can vary depending on the building configuration. As shown, the orientations of the docks 102 may be varied. Such orientations may differ on successive floors to facilitate access to the utility connections via the openings 116.

The illustrated hoistway 106 is sufficiently sized such that a home or section can fit through the hoistway 106. The hoistway openings on each floor may be rectangular in shape. In one embodiment, the hoistway opening is sufficiently large to accommodate an 8'×40' shipping container. In other embodiments, the hoistway opening may be sufficiently large to accommodate a single section home or section of a multi-section home (housing unit). The hoistway openings of the intermediate floors collectively form a hoistway that allows for a housing unit to be transported to a desired floor.

In some embodiments, the hoistway opening can have guide flaps pivotably connected to the edges of the hoistway opening. For a rectangular opening, the guide flaps may be disposed at the shorter edges and/or longer edges of the hoistway opening. The guide flaps can pivot from a first position angled relative to the floor and a second position parallel to the floor. When the housing unit is passing through the hoistway opening, the guide flaps are in the first position to stabilize the housing unit. Once the housing unit is at a desired floor and clears the hoistway opening of that floor, the guide flaps move to the second position to act as partial floors that support the housing unit or section.

In some embodiments, each dock 104 is offset from the docks directly above or below it. The docks 104 may be positioned near a perimeter of the floor 102 and offset relative to the perimeter of the floor. The docks that are on the same floor may be spaced apart from each other to define walkways in between. The spacing between the docks 104 also allows air to pass between the housing units, thereby improving cooling, and improve soundproofing between neighboring homes to allow for more privacy. In some cases, a dock 104 may be dimensioned to accommodate two container units, e.g., in a double wide configuration.

The housing units may be about 8 to 20 feet wide and about 20 to 60 feet long. For example, the housing unit may be a 10'×40' unit, an 8'×40' unit, or an 8'×20' unit. As another example, the housing unit may comprise two sections, each being about 5 to 10 feet wide and about 20 to 60 feet long.

In the illustrated floor plan 100, each dock 104 is sufficiently sized such that the housing unit fits in the dock 104. For example, the dock 104 may be rectangular in shape and between about 8.5 and 20.5 feet wide and about 20.5 to 60.5 feet long. As another example, the dock 104 may be rectangular in shape and over 20.5 feet wide and over 60.5 feet long. Different sized docks 104 may be provided on the same floor or on different floors of a given multi-story building.

The illustrated docks 104 comprise a docking structure recessed into the floor. The docking structure may include a structural grate bounded by a recessed edge. The recessed edge and structural grate are constructed to be sufficiently strong to support a housing unit. In this regard, the recessed edge may be formed from steel and the structural grate may be formed from aluminum or steel. The structural grate defines a number of rectangular, hexagonal, or otherwise shaped cells. Such structural grates provide the desired strength while reducing weight in relation to solid panels.

As noted above, the docks 104 are configured to receive a manufactured home such that the home is partially recessed into the floor. In certain embodiments, the bottom edges of the home are configured to sit on the recessed edge. The docks 104 may be recessed about 3 to 12 inches into the floor, for example, about 4 to 8 inches into the floor. Preferably, the homes are recessed into the floor such that the bottom of a doorway of the home is flush with or slightly above, e.g., no more than about ½ inch above, the building floor. The home may be secured in the docking structure, e.g., by clamps, chains, deployable retaining elements built into the docks, or other retaining structure.

As noted above, the underside of the home may be accessible through the docks 104 from the floor below. In many cases, the utility connections for a housing unit are disposed on the underside of the unit. The utility connections can be accessed from the floor below through the dock 104. In this regard, the dock 104 may include one or more utility openings 116 with covers or panels that can be opened for access to utility connections.

Figure 2:
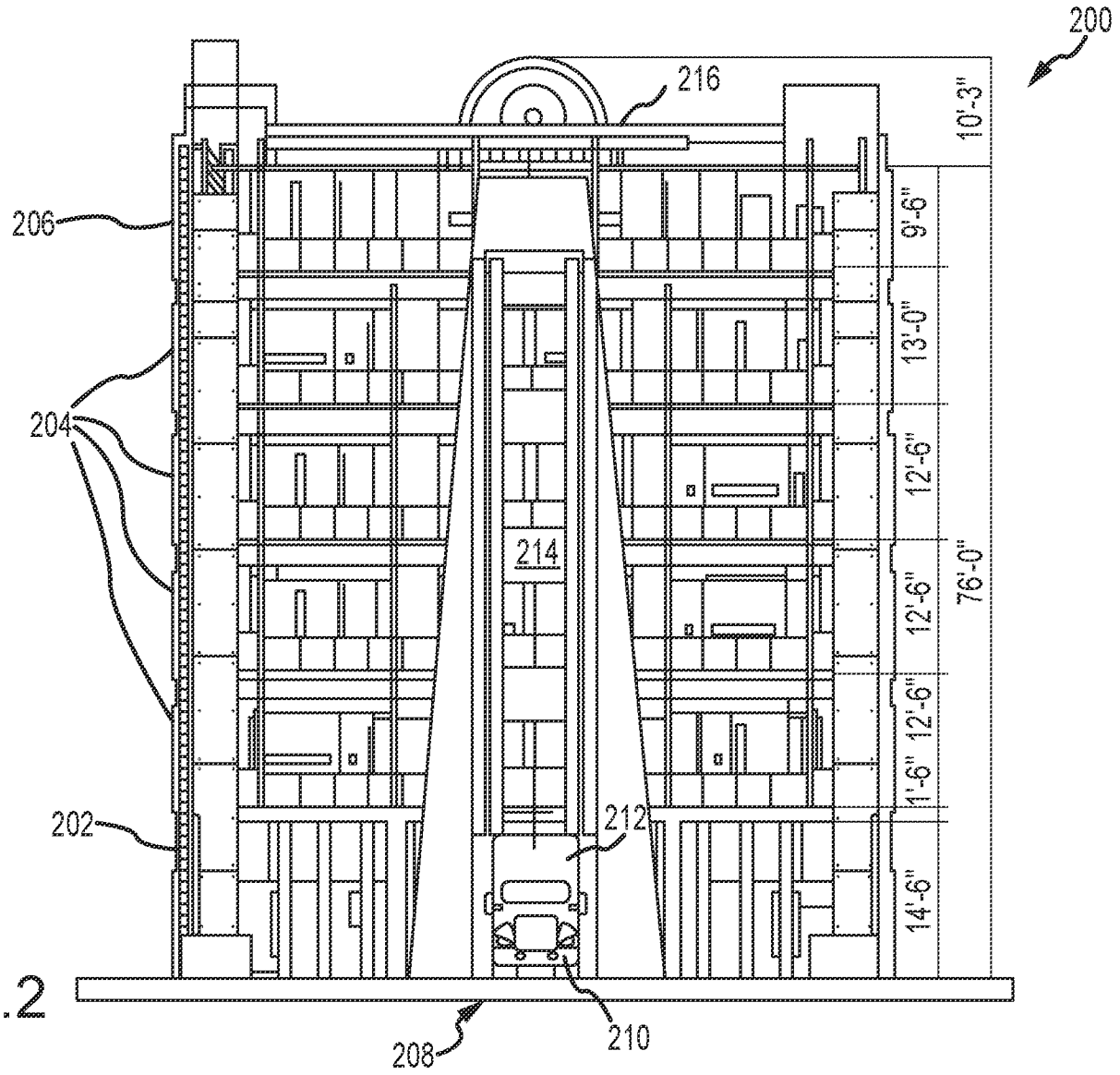
FIG. 2 is a front view of the building of FIG. 1.
Figure 3:
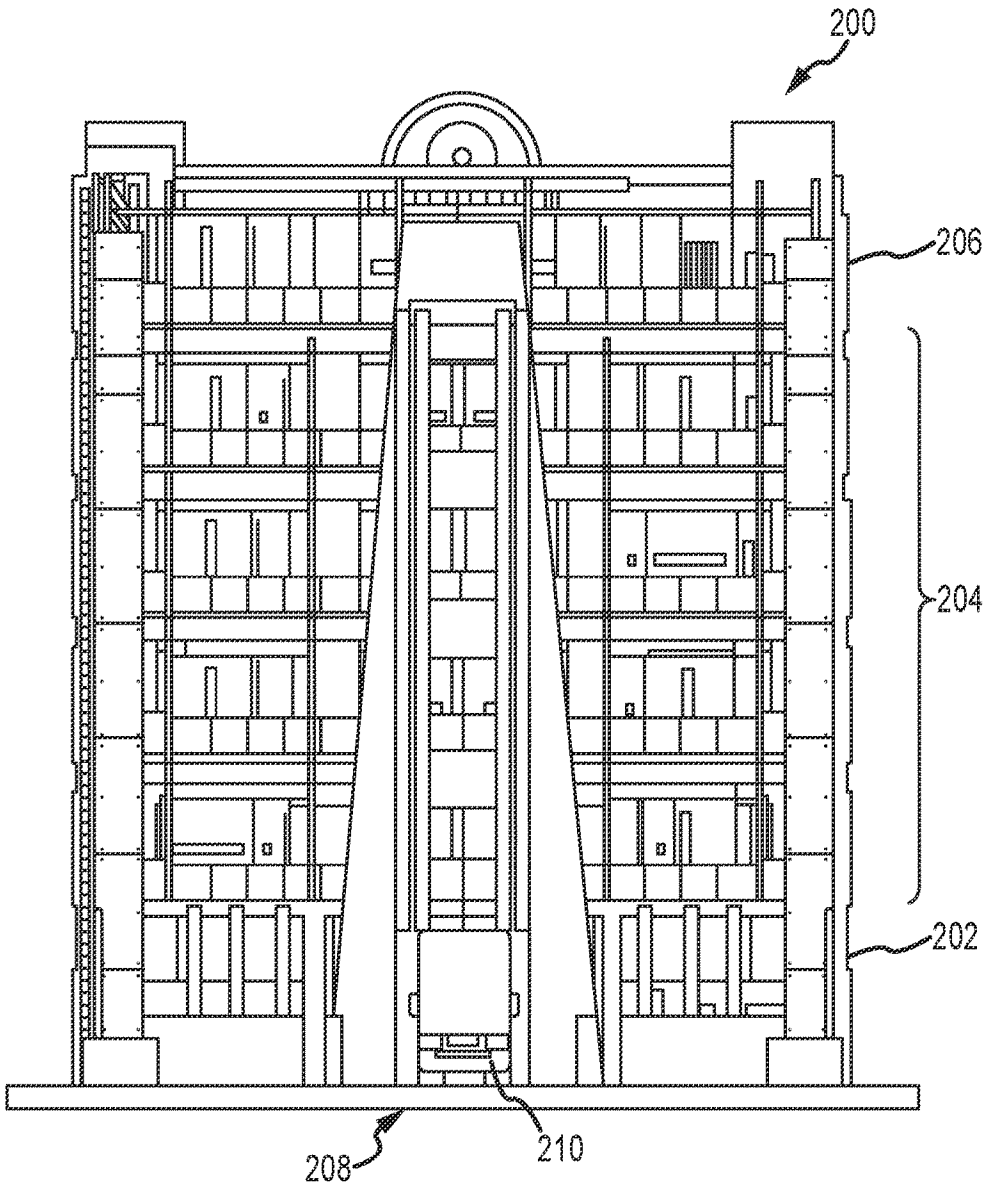
FIG. 3 is a back view of the building of FIG. 1.

FIGS. 2-3 show front and back elevational views of a multi-story building 200 for manufactured homes such as container homes. The illustrated building 200 includes a ground floor 202, and number of intermediate floors 204, and a top floor 206. As shown, the building 200 also includes a throughway 208 on the ground floor 202 that allows passage of a transportation vehicle 210 such as a flatbed truck with a manufactured home disposed thereon. The transportation vehicle 210 can use the throughway 208 to position the manufactured home 212 in alignment with a hoistway 214. A hoist mounted on the roof 216 can then be used to hoist the home to a desired floor 204 or 206.

The ground floor 202 may include spaces for parking as well as the throughway 208. Manufactured homes may be positioned on each of the intermediate floors 204 as well as the top floor 206. The illustrated building 200 has an overall height of about 76 feet as well as about 10'3" of extending roof structure, e.g., to shield the hoist and other infrastructure equipment. In the illustrated embodiment, the ground floor 202 has a height of about 14'6" and the intermediate floors may have a height of about 12'6" to 13 feet. The top floor 206 has a height of about 9'6".

Figure 4:
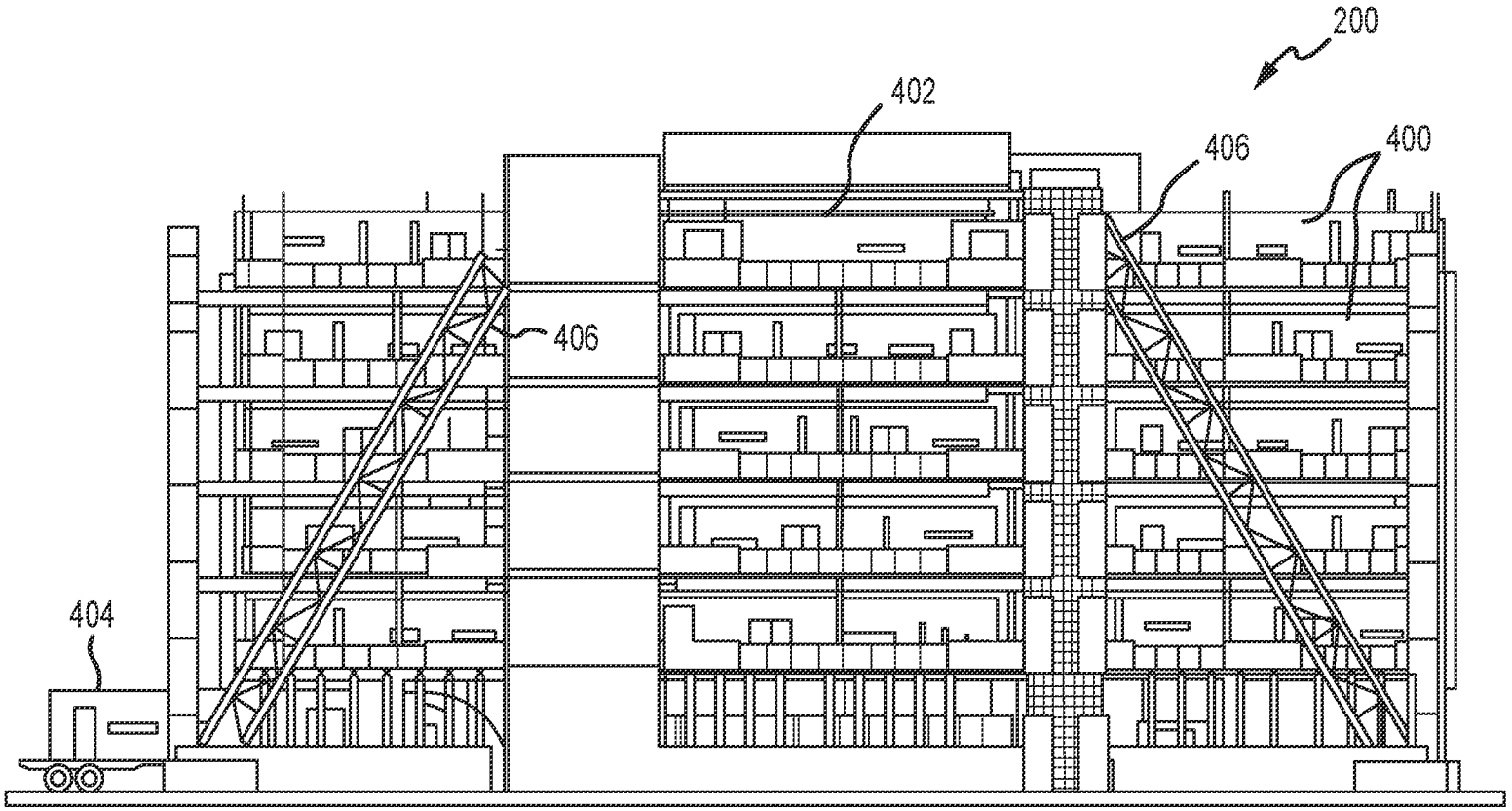
FIG. 4 is a side view of the building of FIG. 1.
Figure 5:
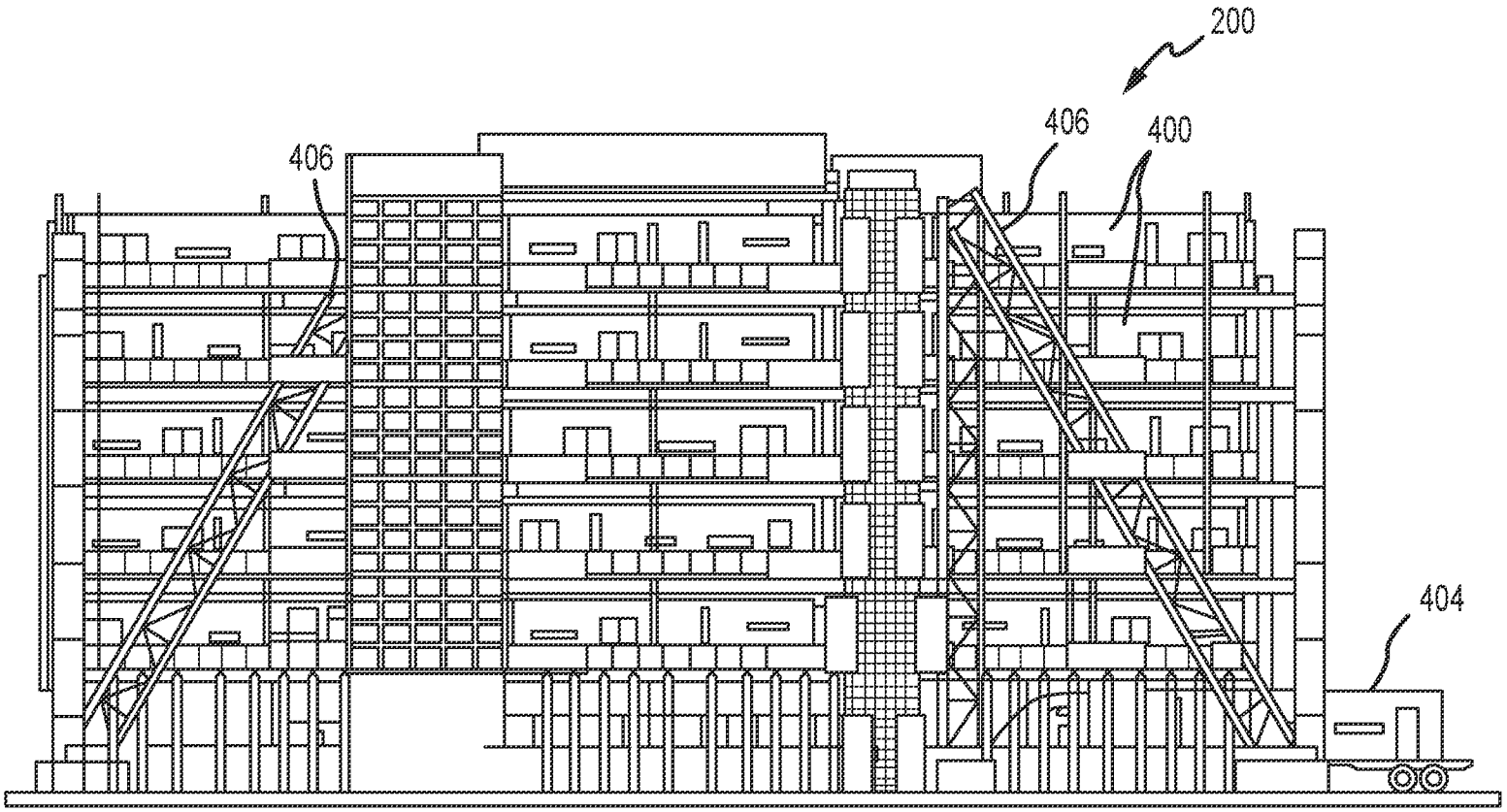
FIG. 5 is an opposite view of the building of FIG. 1.

FIGS. 4-5 show opposite side elevational views of the building 200. As shown, manufactured homes 400 may be positioned in docks on each of the intermediate and upper floors of the building 200. In addition, one or more common areas 402 such as flex areas, culinary areas, exercise areas, gardens or the like may be provided in the building 200. FIGS. 4-5 also show passage of a transportation vehicle 404 into or out of the ground floor of the building 200. Preferably, the throughway extends through the ground floor of the building 200 so that the vehicle 404 can pass through the entire length of the building 200. However, when desired, e.g., when space is limited, the throughway may pass only far enough through the building to allow the vehicle 404 to access the hoistway. Moreover, if desired, the home or housing unit may be unloaded from the truck external to the building so that only the home or unit needs to pass through the throughway.

The illustrated building 200 includes one or more diagonal support beams 406 for improved structural support. For example, the beams 406 may be disposed on at least two sides of the building and span from the ground floor to the top floor. In the illustrated example, the diagonal support beams 406 are located on the longer sides of the building and two support beams 406 are provided on each side of the building. The support beams 406 may comprise a single support beam such as an I-beam or, as shown, may be provided as a framework or truss beam assembly.

Figure 6:
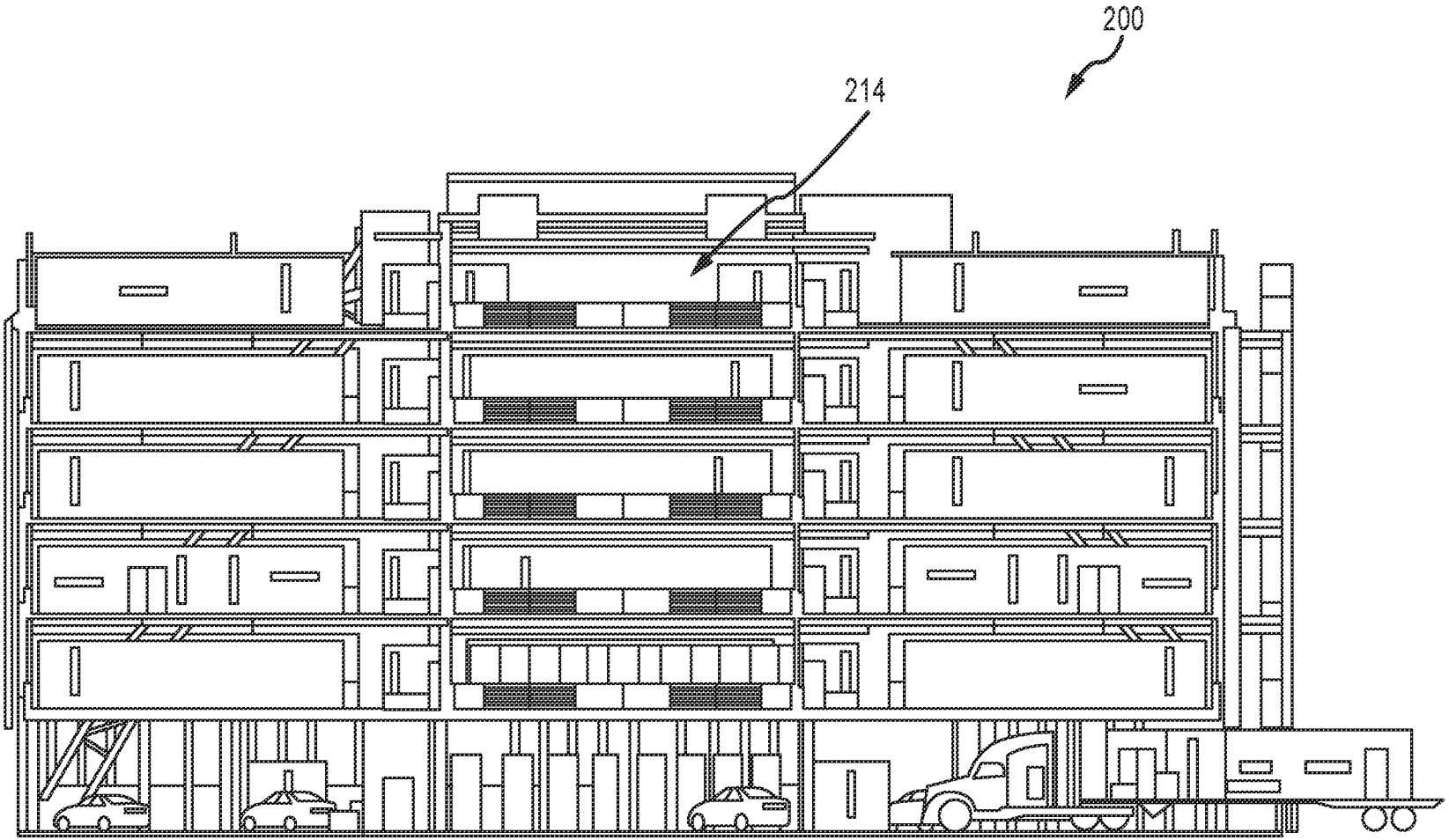
FIG. 6 is a side cross-sectional view of the building of FIG. 1.
Figure 7:
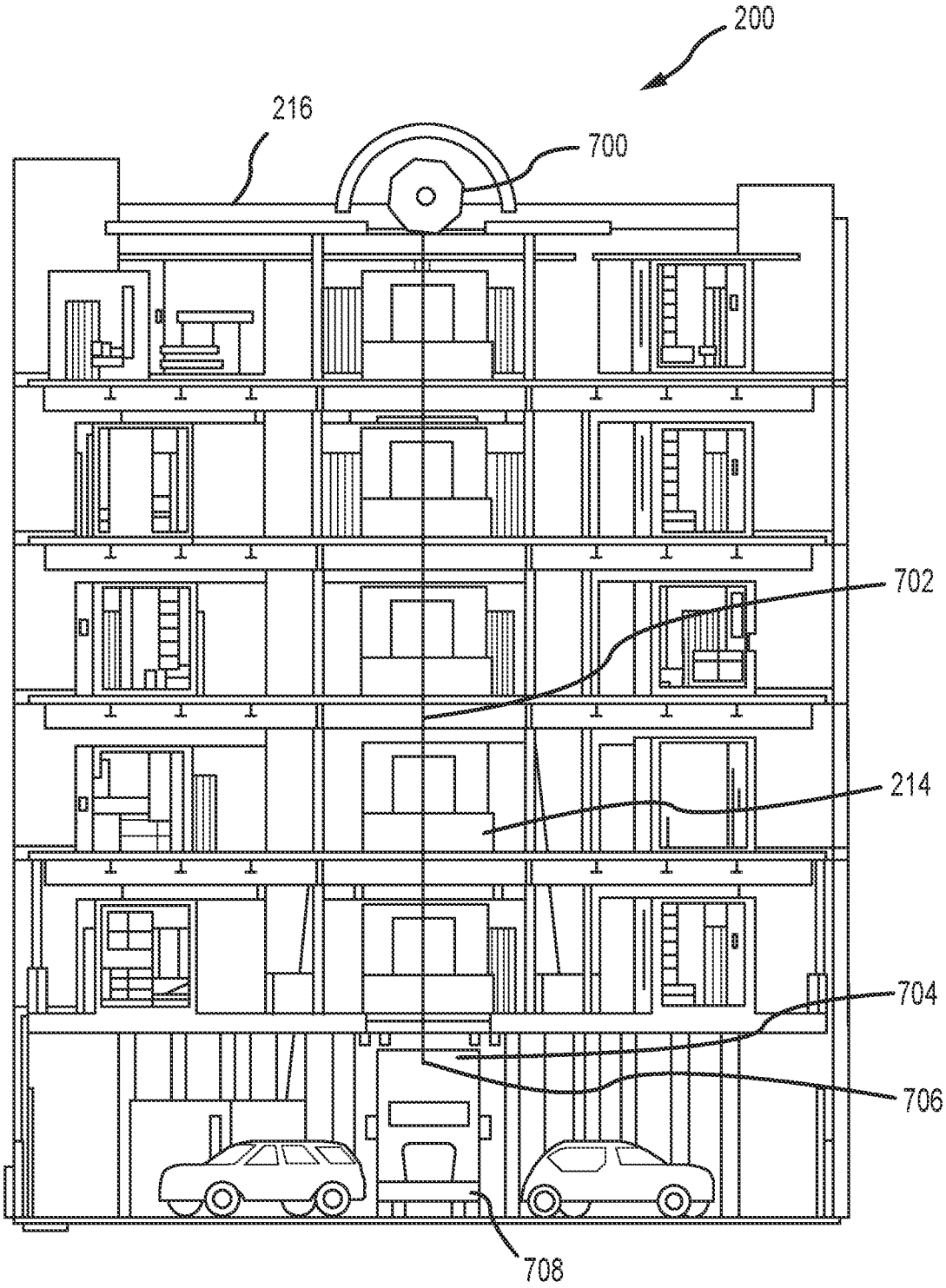
FIG. 7 is a front cross-sectional view of the building of FIG. 1.

FIGS. 6-7 show side and front cross-sectional views of the building 200. In these views, additional details of the hoistway 214 and hoisting system can be seen. Specifically, the hoisting system includes a hoisting drum/winder motor 700 mounted on the roof 216 of the building 200. A hoisting cable 702 can be extended by unwinding the drum to reach a manufactured home 704 on a transportation vehicle 708. One or more hoist hooks 706 at the bottom of the cable 702 can be attached to the manufactured home 704 to lift the home 704 from the bed of the transportation vehicle 708. In cases where multiple cables are utilized, multiple drums/motors may be employed or the cables may be co-driven by a single drum/motor. It will be appreciated that manufactured homes formed from shipping containers include structure for attaching to the hoist hook 706. The hoisting drum/winder motor 700 can then be operated to lift the container unit 704 through the hoistway 214 to the desired floor. As described below, flaps mounted on the edges of the hoistway 214 can be opened to allow passage of the home 704 and then closed to support the home 704 and allow for attachment of wheels or other lateral movement devices to enable movement of the home 704 to a desired dock. Accordingly, the hoisting drum/winder motor 700 may be operated to lift the home 704 slightly above the desired floor to provide clearance to close the flaps. The flaps may then be closed and the hoisting drum/winder motor 700 may be operated to lower the home 704 onto the flaps. In this regard, the wheels may be attached to the home 704 before lowering it onto the flaps or the wheels may be disposed on the flaps and the home 704 may be lowered onto the wheels.

Figure 8:
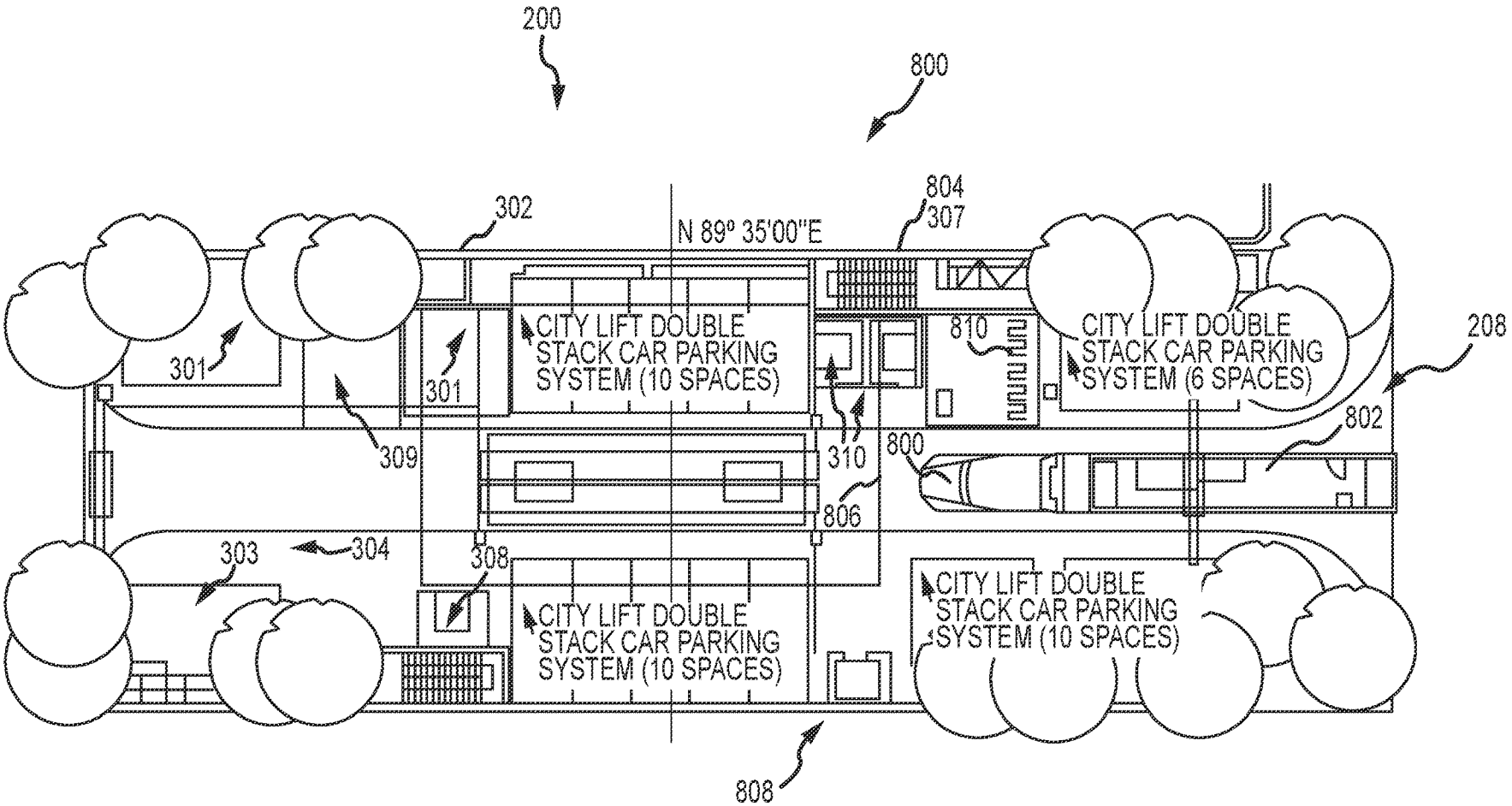
FIG. 8 is a top view of a floor plan for a ground-floor of the building of FIG. 1.

FIG. 8 shows a top view of a floor plan 800 for the ground floor of the building 200. The floor plan 800 includes a throughway 208 extending through the building 200 from front to back. The throughway 208 has a width sufficient to allow passage of a transportation vehicle 204 carrying a manufactured home 802, for example, about 12 feet. In the illustrated example, the building 200 also includes doublestack car parking systems 808. These systems allow two vehicles to be parked in a stacked configuration using a lift mechanism so as to provide more parking spaces within a given spatial footprint. The building 200 may also include bicycle racks 810 as well as a number of rooms or compartments for storage, building infrastructure support, and common areas/flex space for residents of the building 200. For example, the building may include green spaces 301, elevators 302, green space/pet areas 303, service areas 304, stairs 307, a recycle/trash cube 308, a bicycle storage cage 309, and mail/package delivery cubes 310.

Figure 9:
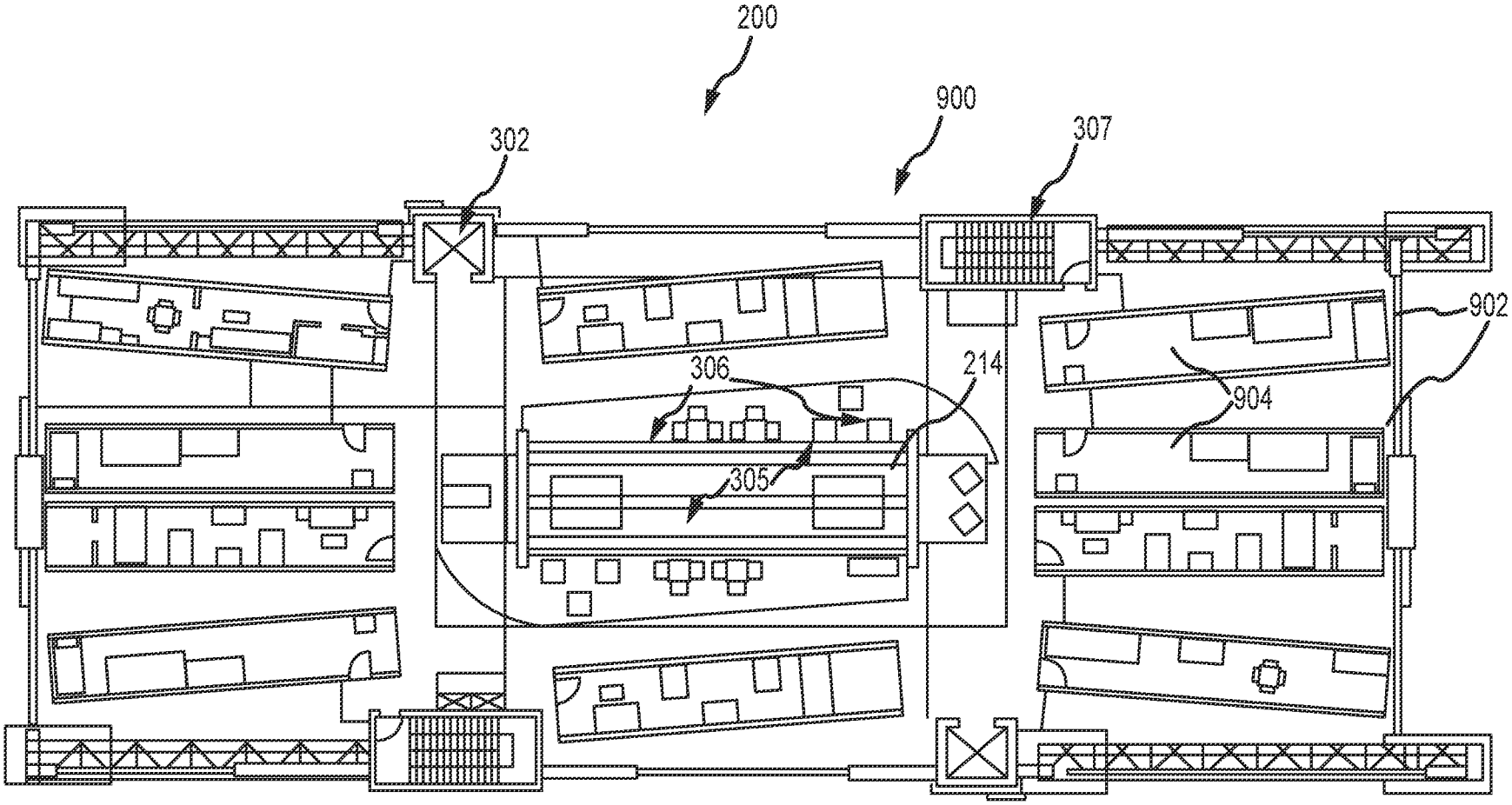
FIG. 9 shows a top view of a floor plan for intermediate floors of the building of FIG. 1.

FIG. 9 shows a top view of a floor plan 900 of an intermediate floor of the building 200. The floor plan 900 includes a number of docks 902 and installed manufactured homes 904. The docks 902 and homes 904 are peripherally distributed about a central hoistway 214. It will be appreciated that this configuration allows access from the hoistway 214 to any one of the docks 902 without interference from homes 904 disposed in any other dock 902. The docks 902 may include single container homes or double container homes arranged in a double wide configuration. At least some of the docks 902 may be oriented at an angle relative to each of the front-to-back and side-to-side axes of the building 200. As will be discussed in more detail below, this allows vertically aligned homes 904 on adjacent floors to be partially offset from one another to facilitate access to an underside of the homes 904 for utility connections among other things. The illustrated floor plan 900 may also include elevators 302, spaces that are open to below 305, common areas 306, and stairs 307.

Figure 10:
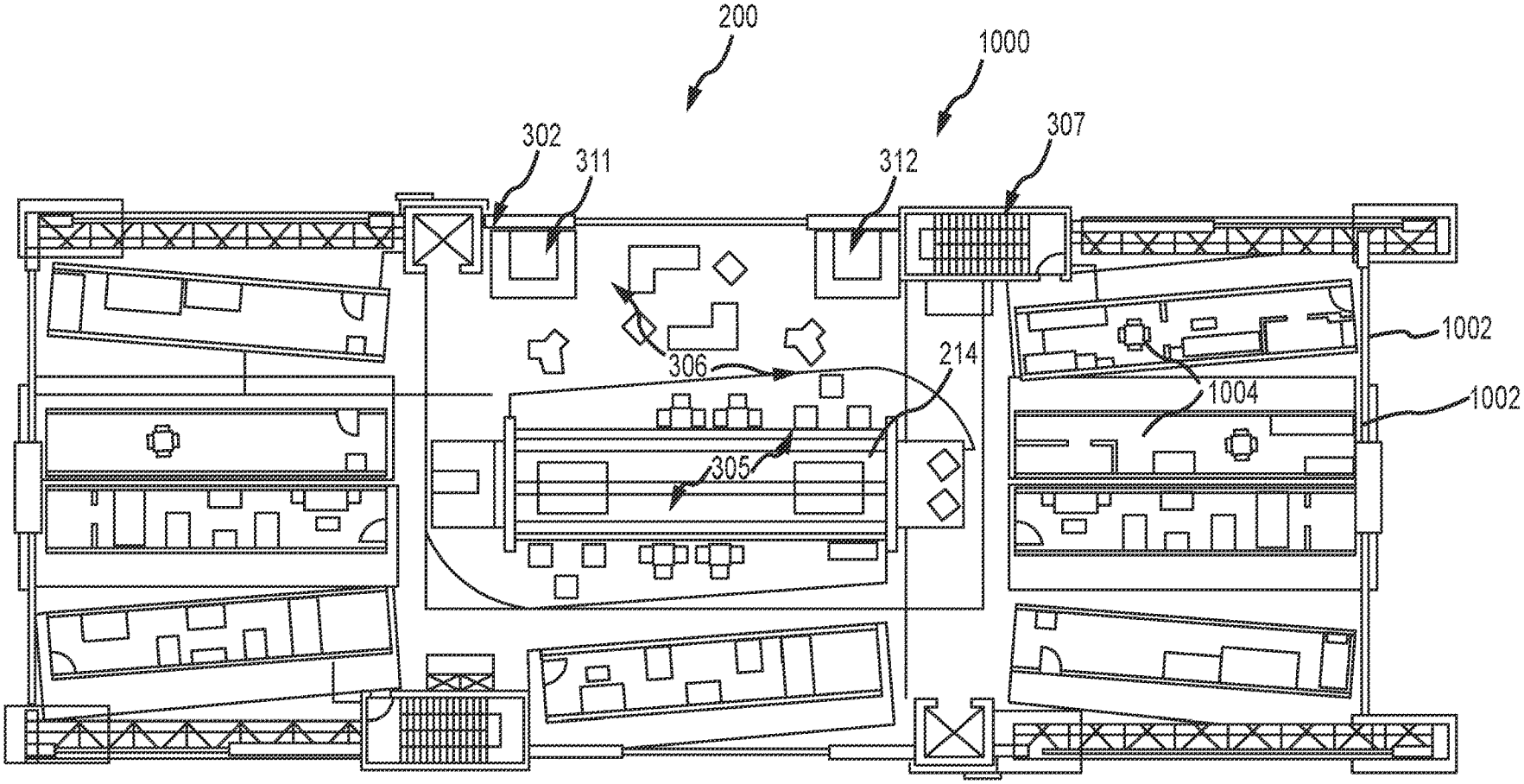
FIG. 10 shows a top view of a floor plan for a top floor of the building of FIG. 1.

FIG. 10 shows a top view of a floor plan 1000 of a top floor of the building 200. The configuration of the top floor may generally be similar to that of intermediate floors including a number of docks 1002 for manufactured homes 1004. Again, the docks 1002 may be peripherally distributed about the central hoistway 214. In the illustrated example, the floor plan 1000 includes common areas 306 that may be used for recreation, relaxation, meetings, and the like. Restrooms 312 for residents of the building 200 may also be provided as well as a culinary cube 311. The floor plan 1000 may also include spaces that are open to below 305, elevators 302, and stairs 307.

Figure 11:
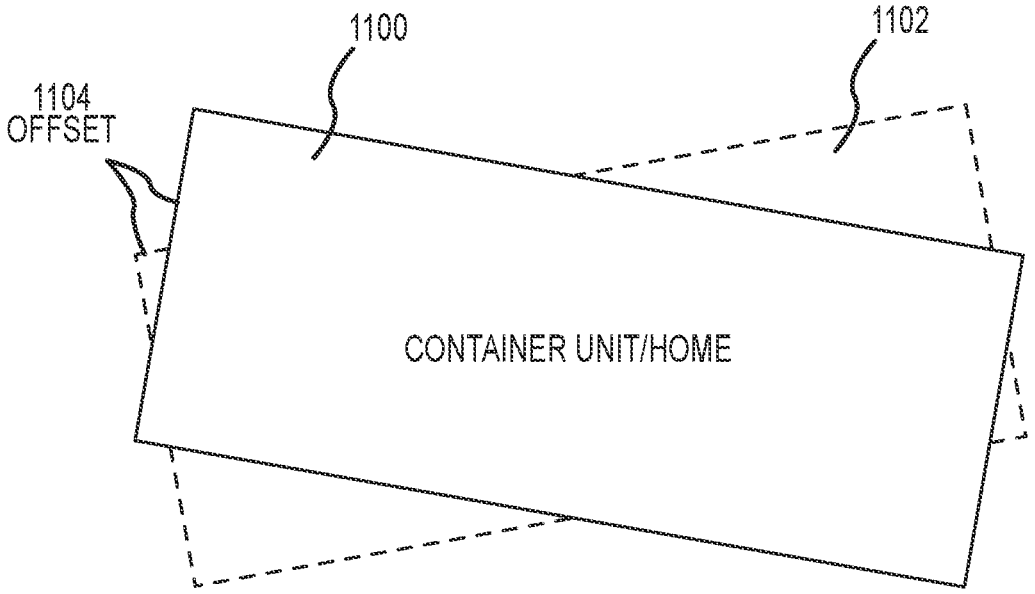
FIG. 11 shows a container home on an upper floor of a building offset from another container home (broken lines) directly below in accordance with the present invention.

As noted above, the docks and associated homes that are vertically aligned on adjacent floors may be disposed at offset orientations to facilitate access to the undersides of the homes. This is schematically illustrated in FIG. 11. As shown, a first home 1100 on a first floor may set at a different orientation from that of a second home 1102 on a floor below that of the first home 1100. This results in offset areas 1104 where the undersides of the homes 1100 and 1102 can be accessed from below. Such access is useful, for example, to allow for connecting and disconnecting utilities such as water, gas, electricity, and Internet/data networks.

Figure 12:
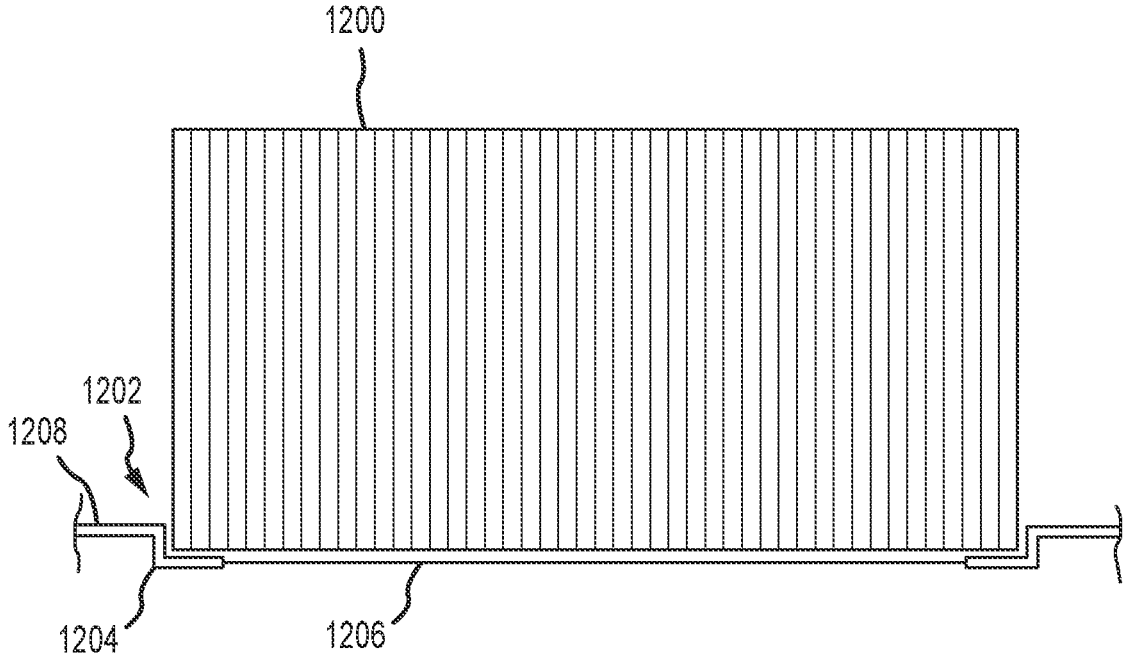
FIG. 12 shows a container home docked and recessed into a floor in accordance with the present invention.

FIG. 12 shows a manufactured home 1200 disposed in a dock 1202. The dock 1202 includes a recessed edge 1204, that extends about at least a portion of the periphery of the dock 1202 and a structural grate 1206 that extends across the opening defined by the recessed edge 1204. A top surface 1208 of the dock 1202 is aligned with or integrated into the building floor. The recessed edge 1204 allows the home 1200 to be recessed into the floor as discussed above.

Figure 13A:
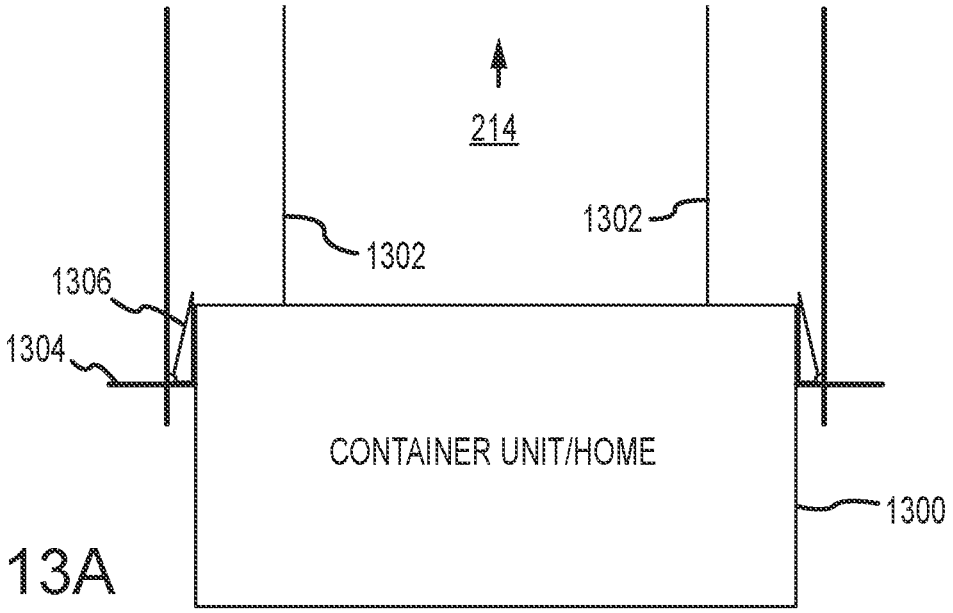
FIGS. 13A-13C show a container home being lifted through a hoistway in accordance with the present invention
Figure 13B:
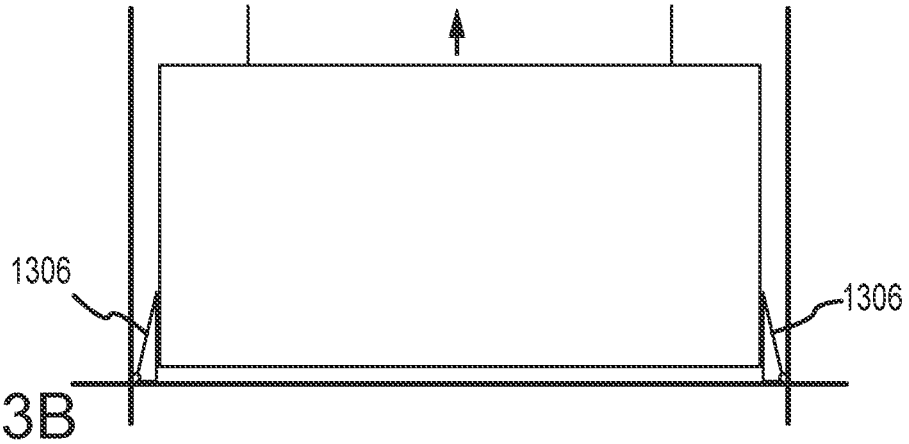
Figure 13C:
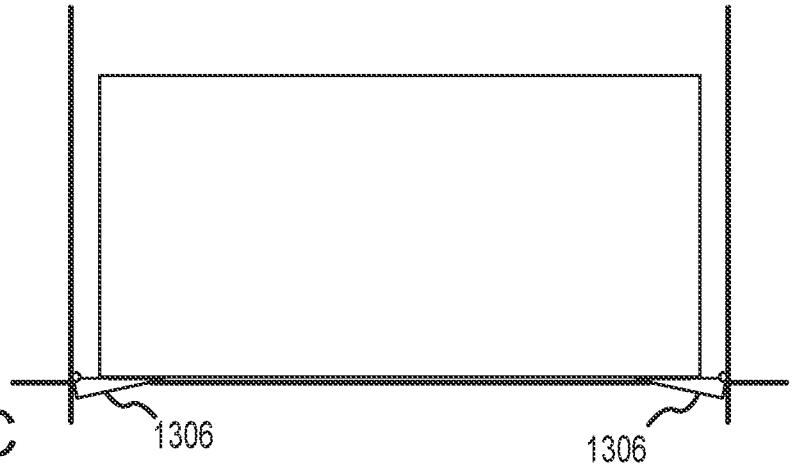

FIGS. 13A-13C illustrate the operation of the home lifting system of the building. As discussed above, one or more hoisting drum/winding motors may be mounted on the roof of the building above the hoistway 214. These can be used to wind the hoist cables 1302 to lift and lower the manufactured home 1300. Guide flaps 1306 are mounted to the floor 1304 of the building adjacent to the hoistway 214. The flaps 1306 can be raised to an open position as shown in FIGS. 13A-13B and lowered to a closed position as shown in FIG. 13C. Thus, the flaps 1306 are opened as the home 1300 is raised through the hoistway 214 to a position slightly above the floor 1304. Once the home 1300 is raised sufficiently above the floor 1304 to provide clearance, the flaps 1306 lower or are lowered to the closed position. The home 1300 can then be lowered onto the flaps 1306. The cables 1302 can then be disconnected from the home 1300. A lateral movement device can then be attached to the home 1300 to move the home from the hoistway 214 to the desired dock on the floor 1304.

Figure 21:
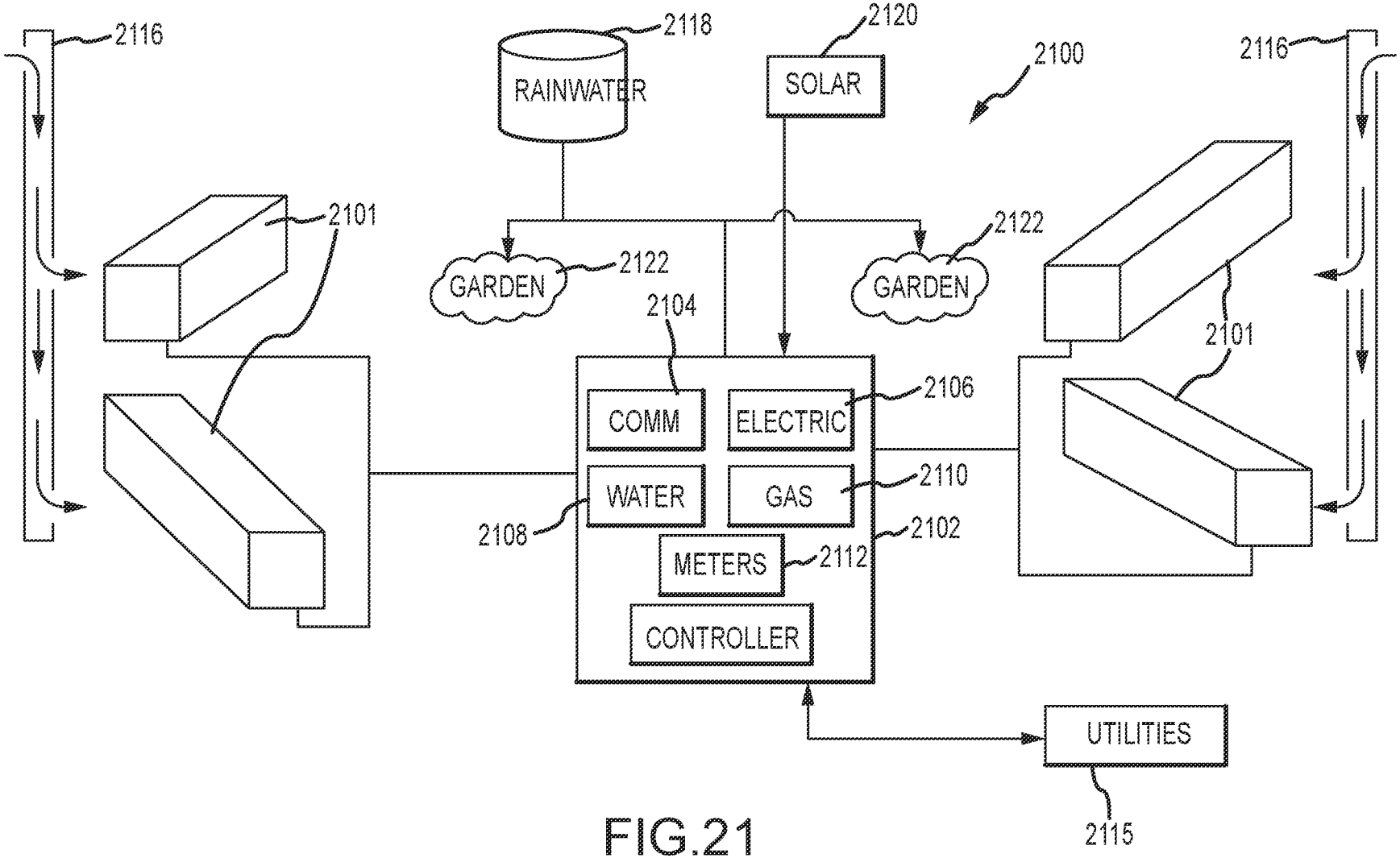
FIG. 21 is a schematic diagram of infrastructure systems for a multi-story building for manufactured homes in accordance with the present invention.

FIG. 21 schematically illustrates certain infrastructure systems 2100 of a multi-story building for manufactured homes in accordance with the present invention. The systems 2100 include a central utilities management module 2102 for controlling delivery of utilities from public utilities companies/sources 2115, as well as from local sources, to the manufactured homes 2101 in the building. The illustrated module 2102 includes ports for communications 2104 such as Internet or other data network connections, electric connections 2106, water connections 2108, and gas connections 2110 for access to propane or natural gas. Meters 2112 may be provided in connection with the lines to each of the homes 2101 for tracking utilities used by the individual homes 2101. In addition, the module 2102 may include a controller 2114 for monitoring and controlling delivery of various utilities. For example, the controller 2114 may manage use of solar power versus utility provided power. In addition, the controller 2114 may intelligently manage use of utilities, e.g., based on current pricing information. In this regard, the controller 2114 may interface with corresponding controllers of utility companies to obtain current pricing information as well as incentives for reduced energy usage during high use intervals. Optionally, the controller 2114 may monitor utility consumption and implement power saving modes for individual units based on recognized patterns. For example, air conditioning units may be switched to a power conservation mode during intervals where residents are out of their homes 2101, e.g., at work or on vacation. It will be appreciated that utility connections may be made to new homes 2101 and terminated as residents enter and leave the building thereby providing great convenience for residents.

The illustrated systems 2100 further include solar systems 2120. The solar systems may include solar panels, for example, disposed on the roof of the building or on individual units and may further include batteries or other storage units. The solar system 2120 is connected to the utilities module 2102 to control distribution of power as between the homes 2101.

A rainwater collection system 2118 is also provided. The system 2118 may include a central reservoir located on the top of the building or multiple reservoirs located on different floors of the building. The system 2118 collects rainwater for use in public areas such as gardens 2122 as well as for use as non-potable water for individual units 2101.

These systems 2100 also include ventilation towers or towers 2116. The towers 2116 may be located at the corners of the building and preferably extend above the highest structure of the building to capture winds. Air is then delivered to the various floors of the building by internal ducts to improve ventilation and provide cooling.

In summary, the buildings for manufactured homes, as thus described, can have stairways, elevators, and fire escapes. The buildings may also have railings and balustrades for patios and balconies.

The buildings may further include air towers and associated ducts that draw air into the building for cooling. The air towers may be located at each corner of the building structure. In addition, the buildings may include a rainwater collection system that harvests rainwater and stores it in reservoirs. The reservoirs may be located on each floor having a floor below it so that the reservoir can supply rainwater to the floor or floors below.

The building may range from, for example, about 60-80 feet in width, and may range from about 140-160 feet in length. For example, the building may be about 68 feet wide and about 150 feet long. Alternatively, the building may be greater than 80 feet wide and greater than 160 feet long.

Although particular buildings have been described above with several floors, it will be appreciated that the buildings may have more or less floors than shown. For example, practical building structures may have between about 3 to 10 stories. However, it is possible to have more than 10 stories. The ground floor may be at least 14 feet tall to accommodate a semi-truck delivering a manufactured home or housing section. The intermediate floors may range from about 11-15 feet in height.

The number of docks on each floor of the buildings may vary depending on the floor plan and configuration. In addition, more than one hoistway may be provided within the buildings. Thus, it will be appreciated that the number of docks on each floor can vary significantly. In the examples discussed above, each floor may have between about 6 to 10 docks. For example, the intermediate floors may each have 10 docks where is the topmost floor may have only eight or nine docks to allow the top floor to have additional rooftop common space for gardens, solar panels, patio furniture, and/or outdoor recreation. It will be appreciated that the building 200 thus supports multiple manufactured homes on limited land space.

As described above, vertically aligned docks on adjacent floors may be set at a sufficient offset angle (e.g., 10-30°) to provide an adequate offset in relation to the unit below so as to accommodate connection of utilities without interference from the unit below. For example, an upper dock may be angled about 20° relative to a lower dock. This also provides greater diversity of outdoor space or patio areas, contributing to an organic aesthetic.

In the illustrated buildings, each dock is recessed in relation to the floor or platform of each story of the multi-story buildings. The docks may be recessed by about 3-6 inches and the manufactured home sits directly on the structural members of the dock. This allows for an ADA compliant threshold without the use of ramps, i.e., a person using a wheelchair can enter the unit without having to use a wheelchair ramp. Furthermore, the lack of floor plates and ramps reduces the building material costs.

As discussed above, the buildings may further include a lifting mechanism disposed on the roofs of the buildings and above the hoistways. The hoisting cables have sufficient length to at least extend to the ground floor. When lifting or lowering a manufactured home, the hoist cables can be securely connected to the home via hooks or other securing mechanisms. The hoist drum can then be rotated, thereby coiling or uncoiling the hoist cables to lift or lower the manufactured home.

In certain embodiments, a façade crane can be used for loading into one side of the building structure. In other embodiments, a central crane can be used for central loading and allows for a covered façade. In other embodiments, a tower crane can be used for 360° loading.

The hoistway openings may have one or more removable panels for covering the hoistway openings and transforming the hoistway openings into catwalks. The flooring panels are designed to fit directly into hoistway opening to allow for access across the hoistway opening when the hoistway is not in use, i.e., the flooring panels transform the hoistway into a walkway.

As described above in connection with FIGS. 13A-13C, guide flaps may be provided in connection with the hoistway. The guide flaps may be designed so that they deploy under pressure exerted by the unit being lifted through the hoistway. Once past the edge of the flooring, the guide flaps drop horizontally, closing into the outer edges of the hoistway. The guide flaps can act as partial floors to allow for attachment of wheels to the manufactured home or home section, disconnection of the lift cables, and horizontal movement of the manufactured home or section. Alternatively, the flaps may be separately opened and closed (e.g., manually).

In one embodiment, the manufactured home or section can be moved laterally by attaching lifting wheels to the home or section. For example, the lifting wheels can be attached to the bottom edges or corners of the home or section and a handle coupled to the wheels allows for control of movement and direction. A motorized unit may be used in this regard. Alternatively or additionally, overhead tramways with support hooks may be provided to assist in lateral movement.

In certain embodiments, the hoistway lift mechanisms are located centrally or in the middle of the building structure, essentially forming an "0" shape when viewed from the top. Alternatively, the hoistway lift mechanism may be positioned near one side of the building essentially forming a "U" shape when viewed from the top. Moreover, more than one hoistway may be provided.

In some embodiments, the building may include a privacy pod, i.e., a flex space that provides more privacy and is available for use by the residents. In other embodiments, the building may include a privacy panel system, which has two primary functions: 1) it breaks up the façade of the units, and 2) it provides privacy to the unit's outdoor space. The privacy panels can be affixed to either units or the building structure itself.

In addition, in some embodiments, the building may include restrooms, shared culinary cubes or kitchens for preparing food, vending machines, a laundry room, and outdoor lounging or eating areas that are available for use by residents. This provides residents with more living space and also allows residents to socialize with each other. The building may also include recycling receptacles, trash receptacles, bicycle storage cages, mail and package delivery areas, and parking spaces.

Utility connections may be clustered into a central utility jack that plugs into the floor of the manufactured home from underneath. Thus, the utilities run and are connected under the the floor. The utility jack may contain connections for all necessary utilities. It connects the unit to the building's smart system. Location of each jack may be in the center of the units, allowing for quick and easy connection. The jack provides security by restricting access to the utilities to authorized persons only.

Rainwater may be collected and stored in reservoirs on the roof, top floor, and/or each floor for use by the floor(s) below. This allows the rainwater to be gravity fed without the need for pumps, maintenance, etc.

Air can be drawn in by the wind towers/ducts at each corner of the building, through the ducts and distributed both passively and directly to cool the outdoor spaces. The cooling towers extend higher than any other structure of the building to catch wind interconnected to the ducts via an unrestricted architectural and structural pipe.

In some embodiments, solar panels may be disposed on the top floor to provide solar power to the building. The solar panels may be connected to the building's smart system. In other embodiments, solar panels may be disposed on the roofs of the top units to provide solar power to those units and, optionally, the units below.

Common areas may be provided at the corners of the building or elsewhere around the perimeter of the building for gardens. They may be watered directly by rainwater or by rainwater delivered from collection reservoirs. In addition, interior gardens may be provided at the perimeter of the hoistway(s). Additional gardens may be provided on the top floor and/or on the roofs of manufactured homes on the top floor. Gardens may also be established on the patios or balconies of the home/building. Rainwater can be used to water any of the gardens.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A system for supporting one or more manufactured homes in a residential environment, each of said manufactured homes having an internal living space built on a structural frame, having a frame bottom, where the structural frame allows the manufactured home to be lifted and moved, said manufactured home having at least one doorway, where a doorway bottom of said doorway is vertically offset from said frame bottom, said system comprising:

a platform having an upper surface for providing access to said one or more manufactured homes; and a platform having an upper surface for providing access to said one or more manufactured homes; and a dock, disposed in said platform, for receiving a first manufactured home, said dock including dock structure defining a recess relative to said platform configured such that, when said first manufactured home including said frame bottom is disposed in said recess, said doorway bottom is no lower than said upper surface of said platform, wherein said dock structure defining said recess comprises a support assembly for supporting said frame bottom, said support assembly including at least one opening for providing access to an underside of said manufactured home, wherein said support assembly comprises a central support structure extending across said recess under said manufactured home.

2. The system of claim 1, wherein, when said first manufactured home including said frame bottom is disposed in said recess, said doorway bottom is aligned with said upper surface of said platform.

3. The system of claim 2, wherein, when said first manufactured home including said frame bottom is disposed in said recess, said doorway bottom is vertically above said upper surface of said platform by a distance of no more than about ½ inch.

4. The system of claim 1, wherein said recess has a depth of between about 3-6 inches relative to said platform.

5. The system of claim 1, wherein said support assembly comprises a ledge disposed about at least a portion of a periphery of said recess and extending inwardly into said recess to support said frame bottom.

6. The system of claim 1, wherein said central support structure includes a plurality of support elements extending across said recess.

7. The system of claim 6, wherein said recess is rectangular and said plurality of support elements include at least a first support element extending across a major axis of said recess and a second support element extending across a minor axis of said support structure.

8. The system of claim 6, wherein said central support structure comprises a structural grating.

9. The system of claim 1, wherein said dock structure further comprises a depending element depending from said platform for interconnecting said platform and said support assembly.

10. The system of claim 1, wherein said manufactured home has one or more utility connections disposed on said underside, wherein said utility connections are accessible from below via said opening.

11. The system of claim 1, wherein said recess is dimensioned to match a footprint of said manufactured home.

* * * * *